US007839061B2

(12) United States Patent
Egi et al.

(10) Patent No.: US 7,839,061 B2
(45) **Date of Patent: *Nov. 23, 2010**

(54) PLASMA DISPLAY PANEL AND FIELD EMISSION DISPLAY

(75) Inventors: Yuji Egi, Kanagawa (JP); Jiro Nishida, Kanagawa (JP); Takeshi Nishi, Kanagawa (JP); Shunpei Yamazaki, Tokyo (JP)

(73) Assignee: Semiconductor Energy Laboratory Co., Ltd., Kanagawa-Ken (JP)

( * ) Notice: Subject to any disclaimer, the term of this patent is extended or adjusted under 35 U.S.C. 154(b) by 414 days.

This patent is subject to a terminal disclaimer.

(21) Appl. No.: 11/950,628

(22) Filed: Dec. 5, 2007

(65) Prior Publication Data

US 2008/0129188 A1 Jun. 5, 2008

(30) Foreign Application Priority Data

Dec. 5, 2006 (JP) ..... 2006-327936

(51) Int. Cl.
*H01J 5/16* (2006.01)

(52) U.S. Cl. ..... 313/110; 359/614

(58) Field of Classification Search ..... 313/110, 313/112; 349/137; 359/613, 614
See application file for complete search history.

(56) References Cited

U.S. PATENT DOCUMENTS 4,721,361 A 1/1988 Van De Ven
6,261,665 B1 * 7/2001 Murata et al. ..... 428/143
6,635,986 B2 10/2003 Yaniv et al.
6,811,274 B2 11/2004 Olczak
6,825,896 B2 11/2004 Goto et al.
6,833,665 B2 * 12/2004 Wachi et al. ..... 313/479
6,951,400 B2 * 10/2005 Chisholm et al. ..... 362/29
7,094,452 B2 8/2006 Yamashita et al.
7,151,580 B2 12/2006 Ueki et al.
7,297,386 B2 11/2007 Suzuki et al.

(Continued)

FOREIGN PATENT DOCUMENTS

JP 07-168006 A 7/1995

(Continued)

OTHER PUBLICATIONS

International Search Report Application No. PCT/JP2007/073125;PCT10174 Dated Jan. 15, 2008.

(Continued)

*Primary Examiner*—Peter Macchiarolo
(74) *Attorney, Agent, or Firm*—Nixon Peabody LLP; Jeffrey L. Costellia

(57) ABSTRACT

To provide a plasma display panel and a field emission display having an anti-reflection function which can further reduce reflection of incident light from an external source. By providing an anti-reflection layer which geometrically includes a plurality of adjacent hexagonal pyramid-shaped projections, reflection of light is prevented. The reflective index changes from a surface side of display screen to an out side (an atmosphere side) due to a physical shape of a hexagonal pyramid. The plurality of hexagonal pyramid-shaped projections can be provided densely without any space remaining, and six surfaces of side of the hexagonal pyramid-shaped projection are each provided at different angles to a base surface. Therefore, light ray can be effectively scattered in many directions.

32 Claims, 28 Drawing Sheets

U.S. PATENT DOCUMENTS

| | | | | |
|---|---|---|---|---|
| 7,301,264 | B2 | 11/2007 | Ohsawa | |
| 7,659,669 | B2 * | 2/2010 | Nishida et al. | 313/582 |
| 2002/0044356 | A1 | 4/2002 | Arakawa et al. | |
| 2003/0102286 | A1 | 6/2003 | Takahara et al. | |
| 2003/0169386 | A1 * | 9/2003 | Goto et al. | 349/65 |
| 2003/0180476 | A1 * | 9/2003 | Yamashita et al. | 428/1.1 |
| 2004/0109303 | A1 | 6/2004 | Olczak | |
| 2004/0109305 | A1 | 6/2004 | Chisholm et al. | |
| 2004/0227446 | A1 | 11/2004 | Fujimoto et al. | |
| 2005/0030461 | A1 | 2/2005 | Ono et al. | |
| 2005/0053790 | A1 | 3/2005 | Kato | |
| 2005/0074579 | A1 * | 4/2005 | Suzuki et al. | 428/141 |
| 2005/0190321 | A1 | 9/2005 | Ohsawa | |
| 2006/0050387 | A1 | 3/2006 | Arakawa et al. | |
| 2006/0139749 | A1 * | 6/2006 | Watanabe et al. | 359/613 |
| 2006/0172119 | A1 | 8/2006 | Hayashi et al. | |
| 2006/0245060 | A1 * | 11/2006 | Goto | 359/614 |
| 2006/0250064 | A1 * | 11/2006 | Park et al. | 313/112 |
| 2007/0284991 | A1 | 12/2007 | Egi et al. | |
| 2008/0042926 | A1 | 2/2008 | Egi et al. | |
| 2008/0129183 | A1 | 6/2008 | Egi et al. | |
| 2008/0129184 | A1 * | 6/2008 | Nishida et al. | 313/484 |
| 2008/0129933 | A1 * | 6/2008 | Nishida et al. | 349/96 |
| 2008/0130122 | A1 * | 6/2008 | Egi et al. | 359/613 |
| 2008/0144180 | A1 | 6/2008 | Nishida et al. | |
| 2008/0158682 | A1 | 7/2008 | Egi et al. | |
| 2008/0165315 | A1 * | 7/2008 | Nishida et al. | 349/137 |
| 2010/0002306 | A1 * | 1/2010 | Goto | 359/614 |

FOREIGN PATENT DOCUMENTS

| | | |
|---|---|---|
| JP | 08-297202 | 11/1996 |
| JP | 2001-264520 | 9/2001 |
| JP | 2003-177207 | 6/2003 |
| JP | 2003-240904 | 8/2003 |
| JP | 2003-248102 | 9/2003 |
| JP | 2003-279705 | 10/2003 |
| JP | 2003-295778 | 10/2003 |
| JP | 2004-085831 | 3/2004 |
| JP | 2004-177781 | 6/2004 |
| JP | 2004-291500 | 10/2004 |
| JP | 2005-064324 | 3/2005 |
| JP | 2005-173457 | 6/2005 |
| JP | 2005-181740 | 7/2005 |
| JP | 2005-264099 | 9/2005 |
| JP | 2006-010831 | 1/2006 |
| JP | 2006-509240 | 3/2006 |
| JP | 2006-133617 | 5/2006 |
| JP | 2006-171229 | 6/2006 |
| JP | 2006-189784 | 7/2006 |
| JP | 2006-313360 | 11/2006 |
| WO | WO-2004/051325 | 6/2004 |
| WO | WO-2005/010572 | 2/2005 |
| WO | WO-2005/088355 | 9/2005 |

OTHER PUBLICATIONS

Written Opinion Application No. PCT/JP2007/073125;PCT10174 Dated Jan. 15, 2008.

International Search Report Application No. PCT/JP2007/073285;PCT10171 Dated Jan. 8, 2008.

Written Opinion Application No. PCT/JP2007/073285;PCT10171 Dated Jan. 8, 2008.

International Search Report Application No. PCT/JP2007/073436;PCT10169 Dated Jan. 8, 2008.

Written Opinion Application No. PCT/JP2007/073436;PCT10169 Dated Jan. 8, 2008.

International Search Report Application No. PCT/JP2007/073289;PCT10172 Dated Jan. 8, 2008.

Written Opinion Application No. PCT/JP/2007/073289;PCT10172 Dated Jan. 8, 2008.

International Search Report Application No. PCT/JP2007/073430;PCT10170 Dated Jan. 8, 2008.

Written Opinion Application No. PCT/JP2007/073430;PCT10170 Dated Jan. 8, 2008.

International Search Report Application No. PCT/JP2007/073432;PCT10175 Dated Jan. 8, 2008.

Written Opinion Application No. PCT/JP2007/073432;PCT10175 Dated Jan. 8, 2008.

International Search Report Application No. PCT/JP2007/073286;PCT10176 Dated Feb. 5, 2008.

Written Opinion Application No. PCT/JP2007/073286;PCT10176 Dated Feb. 5, 2008.

International Search Report Application No. PCT/JP2007/073434;PCT10173 Dated Jan. 8, 2008.

Written Opinion Application No. PCT/JP2007/073434;PCT10173 Dated Jan. 8, 2008.

* cited by examiner

PLASMA DISPLAY PANEL AND FIELD EMISSION DISPLAY

TECHNICAL FIELD

The present invention relates to a plasma display panel having an anti-reflection function and a field emission display having an anti-reflection function.

BACKGROUND ART

In various displays (plasma display panels (hereinafter referred to as PDPs), field emission display (hereinafter referred to as FEDs), and the like), there may be cases where it becomes difficult to see a display screen due to reflection of its surroundings by surface reflection of incident light from an external source; accordingly, visibility is decreased. This is a considerable problem particularly in enlargement of display devices and outdoor use thereof.

For preventing such reflection of incident light from an external source, a method for providing display screens of PDPs and FEDs with an anti-reflection film has been employed. For example, there is a method for providing an anti-reflection film that has a multilayer structure of stacked layers having different refractive indexes so that the film is effective with respect to a wide wavelength range of visible light (e.g., see Reference 1: Japanese Published Patent Application No. 2003-248102). With a multilayer structure, incident light rays from an external source reflected at each interface between the stacked layers interfere with each other and cancel each other out, and this provides an anti-reflection effect.

As an anti-reflection structure, minute cone-shaped or pyramid-shaped projections are arranged over a substrate and reflectance on the surface of the substrate is decreased (e.g., see Reference 2: Japanese Published Patent Application No. 2004-85831)

DISCLOSURE OF INVENTION

However, with the above-described multilayer structure, light rays, which could not be cancelled, of the incident light from an external source reflected at each layer interface, are emitted to a viewer side as reflected light. Further, for mutual cancellation of incident light from an external source, it is necessary to precisely control optical characteristics, thicknesses, and the like of materials of films that are stacked, and it has been difficult to perform anti-reflection treatment on all incident light rays from an external source which enter from various angles. In addition, a cone-shaped or pyramid-shaped anti-reflection structure has not had a sufficient anti-reflection function.

In view of the foregoing, there have been limits on the function of conventional anti-reflection films, and there is a demand for PDPs and REDs having a better anti-reflection function.

It is an object of the present invention to provide a PDP and an FED which are superior in visibility and which have an anti-reflection function that can further reduce reflection of incident light from an external source.

The present invention provides a PDP and an FED which each have an anti-reflection layer which can prevent reflection of light by geometrically including a plurality of adjacent projections each having a hexagonal pyramid-shape (hereinafter referred to as hexagonal pyramid-shaped projections). One feature of the present invention is to change a refractive index of an anti-reflection layer by a physical shape which is a hexagonal pyramid which is protruded toward the outside (the atmosphere side) from a surface of a substrate which serves as a display screen. Because a plurality of hexagonal pyramid-shaped projections can be provided to fill the surface of the substrate without any space remaining and each has six sides provided at different angles to each other with respect to a base, light can be efficiently dispersed in a plurality of directions. The periphery of one hexagonal pyramid-shaped projection is surrounded by other hexagonal pyramid-shaped projections, and each base, each of which forms a hexagonal pyramid-shape in one hexagonal pyramid-shaped projection, shares one base which form a hexagonal pyramid-shape in another, adjacent, hexagonal pyramid-shaped projection.

Projections having a hexagonal pyramid-shape included in an anti-reflection layer of the present invention are of a form such that they can be provided in a close-packed manner without any space remaining, and light can be efficiently dispersed in a plurality of directions because among such forms, this form has the largest number of sides. Therefore, such projections function well in an anti-reflection sense.

As for the anti-reflective layer of the present invention, it is preferable that an interval between apexes of a plurality of hexagonal pyramid-shaped projections is 350 nm or less and the height of the plurality of hexagonal pyramid-shaped projections is 800 nm or more. Further, a filling rate (a filling (occupying) rate on a substrate which serves as a display screen) of a bases of the plurality of hexagonal pyramid-shaped projections per unit area on a substrate which serves as a display screen is preferably 80% or more, more preferably 90% or more. The filling rate is a rate of a formation region of a hexagonal pyramid-shaped projection over the substrate which serves as a display screen. When the filling rate is 80% or more, a rate of a planar portion where a hexagonal pyramid-shaped projection is not formed over the substrate which serves as a display screen is 20% or less.

The present invention can provide a PDP and an FED which each have an anti-reflection layer including a plurality of adjacent hexagonal pyramid-shaped projections. As a result, a PDP and an FED which each function well in an anti-reflection sense can be provided.

In the present invention, a PDP may be a main body of a display panel having a discharge cell, or a display device to which a flexible printed circuit (an FPC) or a printed wiring board (a PWB) which are provided with one or more of an IC, a resistor, a capacitor, an inductor, and a transistor is attached. In addition, a PDP includes an optical filter having functions such as an electromagnetic wave shielding function or a near infrared ray shielding function.

Further, the FED includes a main body of a display panel having a light-emitting cell, or a display device to which a flexible printed circuit (an FPC) or a printed wiring board (a PWB) which are provided with one or more of an IC, a resistor, a capacitor, an inductor, and a transistor is attached. In addition, an FED includes an optical filter having functions such as an electromagnetic wave shielding function or a near infrared ray shielding function.

The PDP and the FED of the present invention are each provided with an anti-reflection layer having a plurality of hexagonal pyramid-shaped projections arranged without any space remaining on a surface. Since a surface of a side of a hexagonal pyramid-shaped projection is not a plane surface (a surface parallel to a display screen), incident light from external source does not reflect to a viewer side but reflects on another adjacent hexagonal pyramid-shaped projection, or travels between the hexagonal pyramid-shaped projections. In addition, the hexagonal pyramid-shaped with a hexagonal base has a form which can be provided in a close-packed manner without any space remaining and among such forms this form has the largest number of surfaces of side thereof, light can be efficiently dispersed in a plurality of directions, so that it is an optimum form which can function well in an anti-reflection sense. Incident light from external source is partly transmitted through a hexagonal pyramid-shaped projection, and a reflected light ray then enters an adjacent hexagonal pyramid-shaped projection. In this manner, incident light from external source reflected at an interface between adjacent hexagonal pyramid-shaped projections repeatedly enters other projections.

In other words, the number of times that incident light from external source, which enters the anti-reflection layer, is partially transmitted through the hexagonal pyramid-shaped projections of the anti-reflection layer is increased. Therefore, the amount of incident light from external source transmitted through the hexagonal pyramid-shaped projection of the anti-reflection layer is increased, so that the amount of incident light from external source reflected to a viewer side can be reduced, and the cause of a reduction in visibility such as reflection can be prevented. Consequently, a PDP and an FED which have a high definition and high performance can be manufactured.

BEST MODE FOR CARRYING OUT THE INVENTION

Figure 1A:
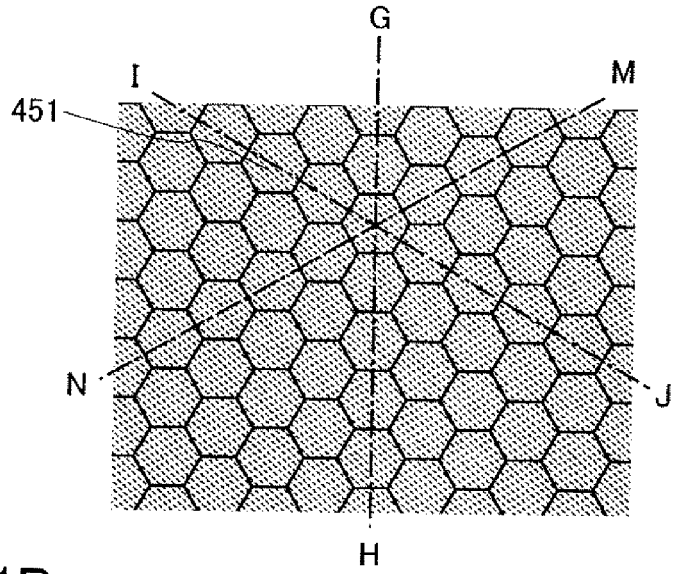
FIGS. 1A to 1D are conceptual diagrams of the present invention.

Embodiment modes of the present invention will be hereinafter described with reference to the drawings. However, the present invention can be implemented in many different modes, and it will be easily understood by those skilled in the art that modes and details herein disclosed can be modified in various ways without departing from the spirit and the scope of the present invention. Therefore, the invention should not be construed as being limited to the description of the embodiment modes. Note that in the drawings which illustrate the embodiment modes, like reference numerals are given to like parts or parts with like functions, and repetitive explanation of such parts is omitted.

Embodiment Mode 1

This embodiment mode will describe an anti-reflection layer which is provided to a PDP and an FED in the present invention. Specifically, an example of an anti-reflection layer having an anti-reflection function capable of further reducing reflection of incident light on a surface of a PDP or an FED from an external source, thereby providing the PDP or FED with excellent visibility, will be described.

Figure 1B:
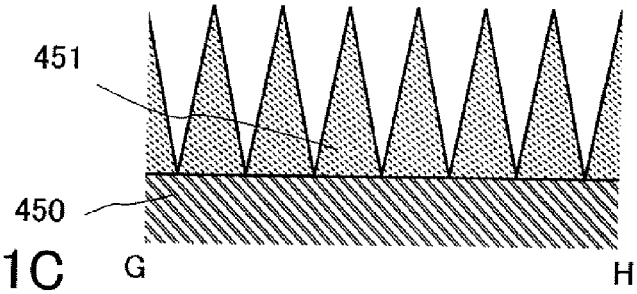
Figure 1C:
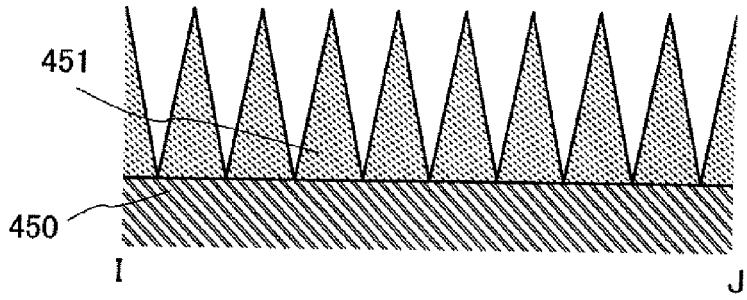
Figure 1D:
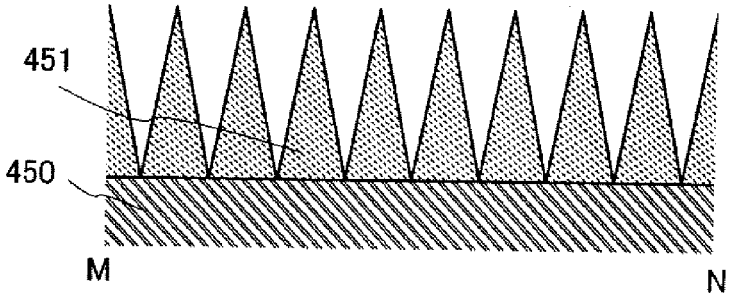

FIGS. 1A to 1D show a top view and cross-sectional views of an anti-reflection layer of the present invention. In FIGS. 1A to 1D, a plurality of hexagonal pyramid-shaped projections 451 are provided on a substrate 450 which serves as a display screen. The anti-reflection layer is formed from the plurality of hexagonal pyramid-shaped projections 451. FIG. 1A is a top view of the PDP or the FED of this embodiment mode, FIG. 1B is a cross-sectional view taken along a line G-H in FIG. 1A, FIG. 1C is a cross-sectional view taken along a line I-J in FIG. 1A, and FIG. 1D is a cross-sectional view taken along a line M-N in FIG. 1A. As shown in FIGS. 1A to 1D, the hexagonal pyramid-shaped projections 451 are provided adjacent to each other so as to fill a surface of the substrate which serve as a display screen. Note that 'display screen' here refers to a surface of a viewer side of a substrate which is provided closest to the viewer side among a plurality of substrates which are included in a display device.

When an anti-reflection layer has a plane surface portion (a surface which is parallel to the display screen) with respect to incident light from external source, the incident light from external source is reflected to a viewer side; therefore, an anti-reflection layer having less plane surface region with respect to incident light from external source has a better anti-reflection function. Further, a surface of the anti-reflection layer is preferably formed to have a plurality of angles for further scattering incident light from external source.

The hexagonal pyramid-shaped projections in the present invention are of form which can be provided in a close-packed manner without any space remaining and among such forms this form has the largest number of surfaces of side thereof; it is an optimum form which can function well in an anti-reflection sense, so that light can be efficiently dispersed in a plurality of directions.

The plurality of hexagonal pyramid-shaped projections are provided in contact with each other so as to be geometrically consecutive. Each base which forms a hexagonal pyramid of a hexagonal pyramid-shaped projection is provided in contact with one base which forms a hexagonal pyramid of an adjacent hexagonal pyramid-shaped projection. Thus, in this embodiment mode, as shown in FIG. 1A, the plurality of hexagonal pyramid-shaped projections cover the surface of the substrate which serves as a display screen without any space. Thus, as shown in FIGS. 1B to 1D, a plane surface portion which is parallel to the display screen does not exist because it is covered by the plurality of hexagonal pyramid-shaped projections, and incident light from external source is incident on slants of the plurality of hexagonal pyramid-shaped projections; and accordingly, reflection of the incident light from external source on a plane surface portion can be reduced. In addition, the hexagonal pyramid-shaped projections are preferable because they have many surfaces of side thereof having different angles with respect to bases, so incident light is scattered in more directions.

Furthermore, corners of the base of the hexagonal pyramid-shaped projection are in contact with corners of the bases of other plurality of hexagonal pyramid-shaped projections, and the hexagonal pyramid-shaped projection is surrounded by a plurality of surfaces of side of the other plurality of hexagonal pyramid-shaped projections provided with different angles; thus, light is easily reflected to many directions. Accordingly, the hexagonal pyramid-shaped projection having many corners of the base has a better anti-reflection function.

The plurality of hexagonal pyramid-shaped projections 451 of this embodiment mode are provided so that adjacent apexes of the plurality of hexagonal pyramid-shaped projections 451 are provided at regular intervals; thus, the plurality of hexagonal pyramid-shaped projections have the same cross section as shown in FIGS. 1B to 1D.

Figure 3A:
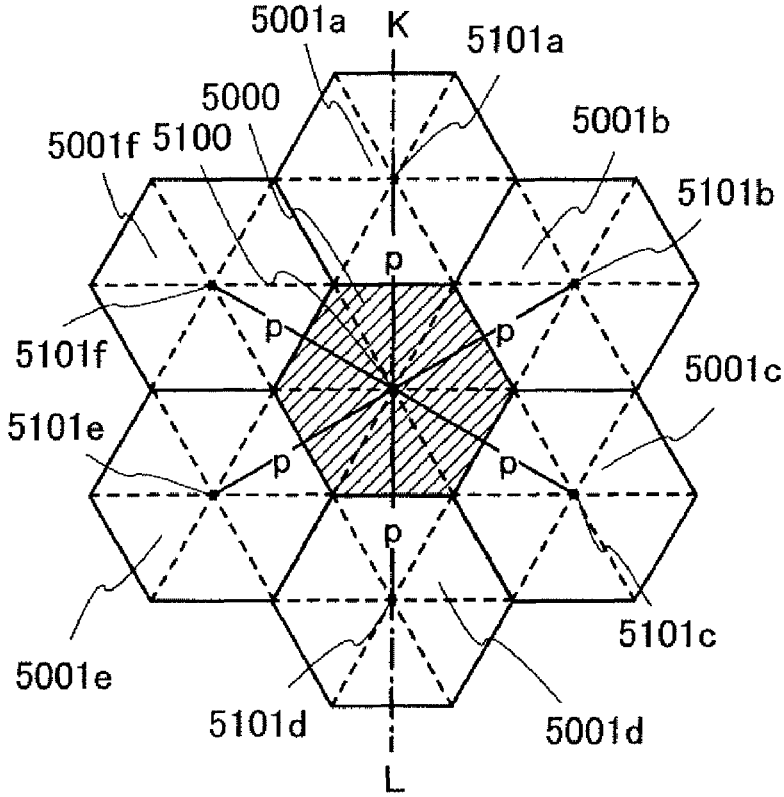
FIGS. 3A and 3B are conceptual diagrams of the present invention.
Figure 3B:
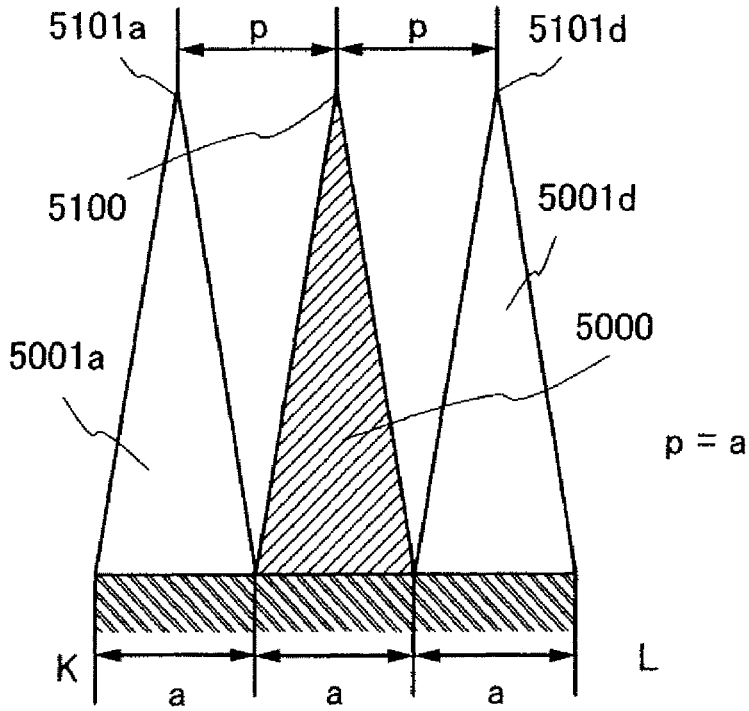

FIG. 3A shows a top view of an example of hexagonal pyramid-shaped projections of the invention which are adjacent to each other and densely arranged. FIG. 3B is a cross-sectional view taken along a line K-L in FIG. 3A. A hexagonal pyramid-shaped projection 5000 is in contact with each of surrounding hexagonal pyramid-shaped projections 5001*a* to 5001*f* at each side of a base (a side of a base which forms a hexagon). Bases of each of the hexagonal pyramid-shaped projection 5000 and the hexagonal pyramid-shaped projections 5001*a* to 5001*f* which are densely arranged around the hexagonal pyramid projection 5000 are a regular hexagons, and apexes 5100 and 5101*a* to 5101*f* are provided in the center of the regular hexagons. Thus, intervals p between the apex 5100 of the hexagonal pyramid-shaped projection 5000 and each of the apexes 5101*a* to 5101*f* of the hexagonal pyramid-shaped projections 5001*a* to 5001*f*, respectively, which are in contact with the hexagonal pyramid-shaped projection 5000, are the same. In addition, in this case, as shown in FIG. 3B, the interval p between the apexes of the hexagonal pyramid-shaped projections is equal to a width a of the hexagonal pyramid-shaped projection.

Figure 8A:
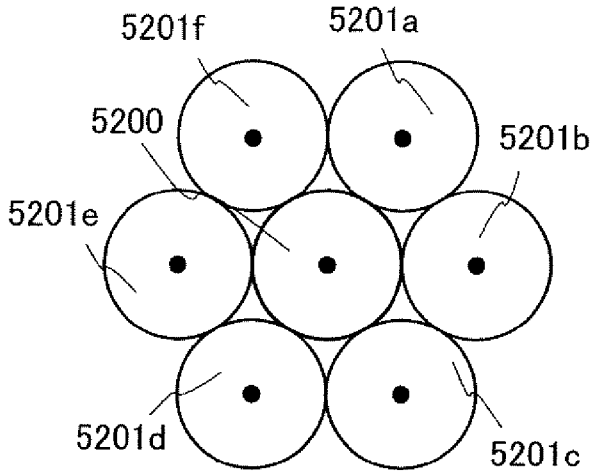
FIGS. 8A to 8C are views showing experimental models of a comparative example.
Figure 8B:
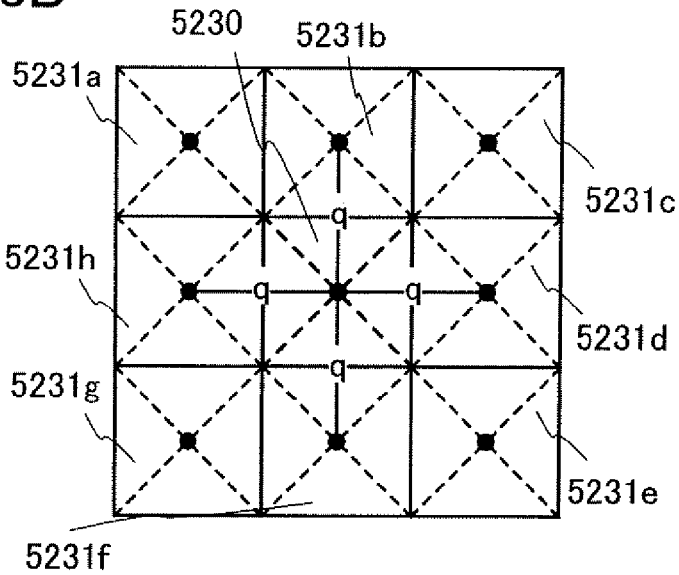
Figure 8C:
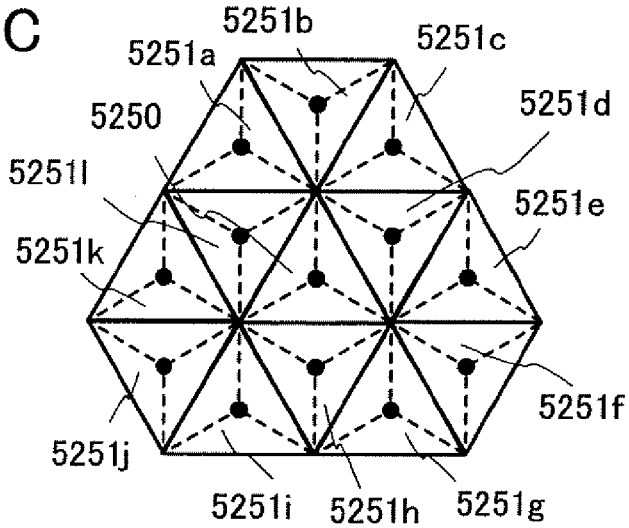

FIGS. 8A to 8C show, as comparative examples, cases of providing each of cone-shaped projections, square pyramid projections, and triangular pyramid projections such that they are adjacent to each other. FIG. 8A shows a structure in which cone-shaped projections are densely arranged, FIG. 8B shows a structure in which the square pyramid projections are densely arranged, and FIG. 8C shows a structure in which the triangular pyramid projections are densely arranged. FIGS. 8A to 8C are top views in which the cones and pyramids projections are seen from the above. As shown in FIG. 8A, cone-shaped projections 5201*a* to 5201*f* are arranged in a close-packed, dense manner around a central cone-shaped projection 5200. However, since a base is a circle, spaces are formed between the cone-shaped projection 5200 and the cone-shaped projections 5201*a* to 5201*f* and a plane surface portion of flat display screen is exposed even if they are arranged in the close and dense manner. Since incident light from external source is reflected to a viewing side on a plane surface, an anti-reflection function of an anti-reflection layer in which the cone-shaped projections are adjacent to each other is decreased.

In FIG. 8B, square pyramid projections 5231*a* to 5231*h* are densely arranged in contact with a square of a base of a central square pyramid projection 5230. In a similar manner, in FIG. 8C, triangular pyramid projections 5251*a* to 52511 are densely arranged in contact with a regular triangle of a base of a central triangular pyramid projection 5250. Since the square pyramid projection and the triangular pyramid projection have smaller number of surfaces of side thereof than the hexagonal pyramid-shaped projection, light cannot be easily scattered in many directions. In addition, although the hexagonal pyramid-shaped projections can be arranged with equal intervals between the apexes of adjacent pyramids, the square pyramids and the triangular pyramids shown in the comparative examples cannot be arranged with equal intervals between the apexes of adjacent pyramids and cones indicated by dots in FIGS. 8A to 8C.

Figure 25:
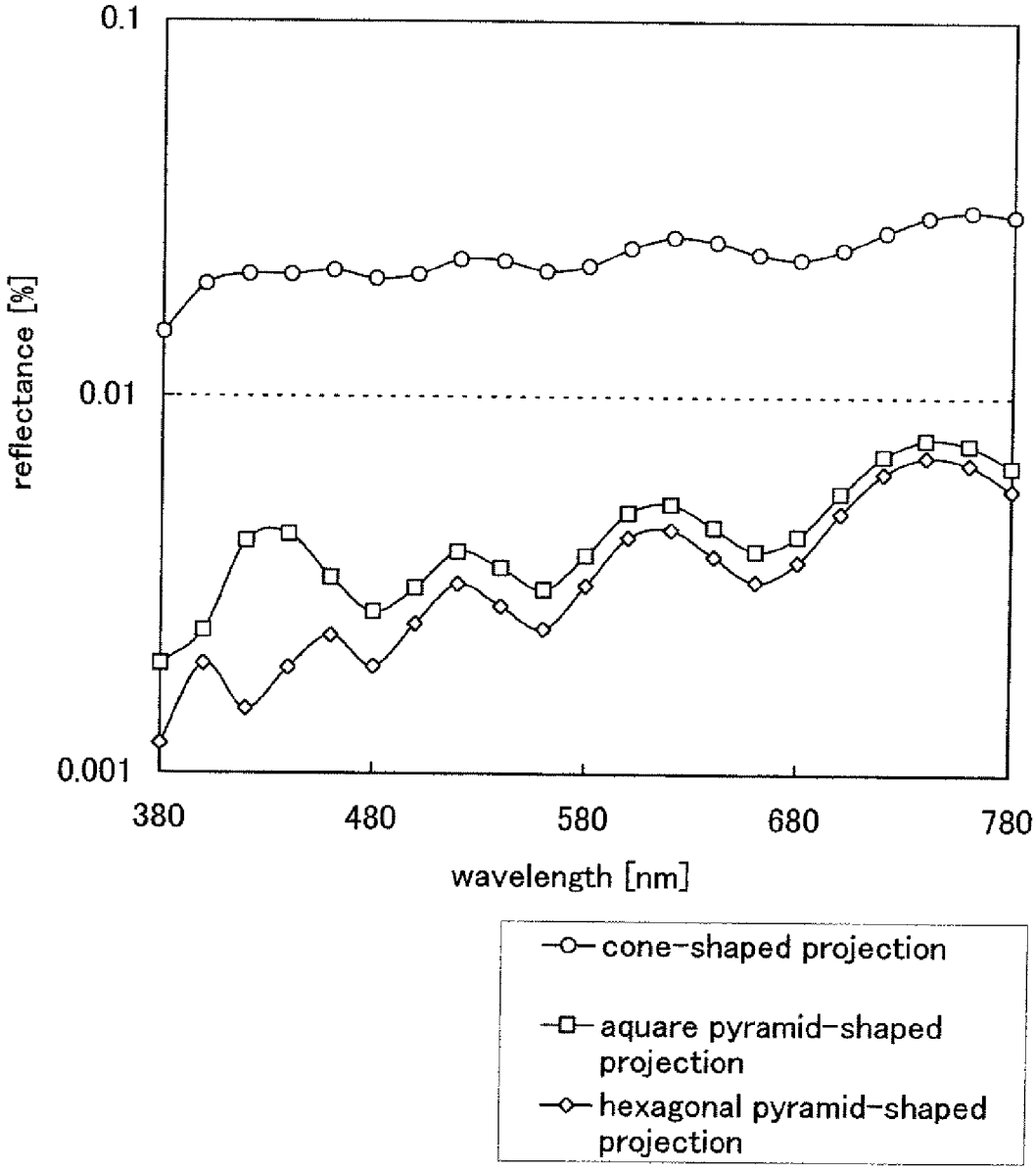
FIG. 25 is a graph showing experimental data of Embodiment Mode 1.

Results of optical calculation for the cone-shaped projections, the square pyramid projections, and the hexagonal pyramid-shaped projections of the present invention are described hereinafter. The calculations in this embodiment were conducted using an optical calculation simulator for optical devices, Diffract MOD (manufactured by RSoft Design Group, Inc.). The reflectance was calculated by three-dimensional optical calculation. FIG. 25 shows the relationship between a wavelength of light and reflectance for each of the cone-shaped projections, the square pyramid projections, and the hexagonal pyramid-shaped projections. As a calculation condition, Harmonics, a parameter of the above calculation simulator was set at 3 in both X and Y directions. In the case of the cone-shaped projections and the hexagonal pyramid-shaped projections, an interval between apexes of cone and pyramid projections was denoted by p and the height of cone and pyramid projections was denoted by b. Index Res., a parameter of the above calculation simulator, was set as a value calculated by $\sqrt{3}\times p/128$, p/128, and b/80 in X, Y, Z directions respectively. In a square pyramid shown in FIG. 8, an interval of apexes of the pyramid projection is denoted by q, and Index res., which is a parameter of the above calculation simulator, was set as values calculated by q/64 in the X and Y directions and b/80 in Z direction.

In FIG. 25, the relationships between wavelength and reflectance for the cone-shaped projections, the square pyramid projections, and the hexagoal pyramid projections are denoted by circular data markers, square data markers, and diamond-shaped data markers, respectively. According to the results of the optical calculations, in the wavelength range of 380 to 780 nm, for which a model filled with the hexagonal pyramid-shaped projections of the present invention was measured, the reflectance was lower than for comparative examples filled with the cone-shaped projections and the square pyramid projections; thus, these results confirmed that the hexagonal pyramid-shaped projections can reduce reflection the most. Note that for each of the cone-shaped projection, the square pyramid projection, and the hexagonal pyramid-shaped projection, a refractive index, a height, and a width were set at 1.492, 1500 nm, and 300 nm, respectively.

When the filling rate per unit area of the surface of the display screen (that is, the surface of the substrate to serve as the display screen) with the bases of the plurality of hexagonal pyramid-shaped projections is 80% or more, preferably 90% or more, the rate of incident light from an external source which is incident on a plane surface portion is reduced, so reflection to a viewer side can be prevented, which is preferable. The filling rate is a rate of a formation region of the hexagonal pyramid-shaped projections over the substrate which serves as the display screen. If the filling rate is 80% or more, a rate of a surface of the substrate which serves as the surface of the display screen which is a plane surface over which hexagonal pyramid-shaped projections are not formed is 20% or less.

Figure 26:
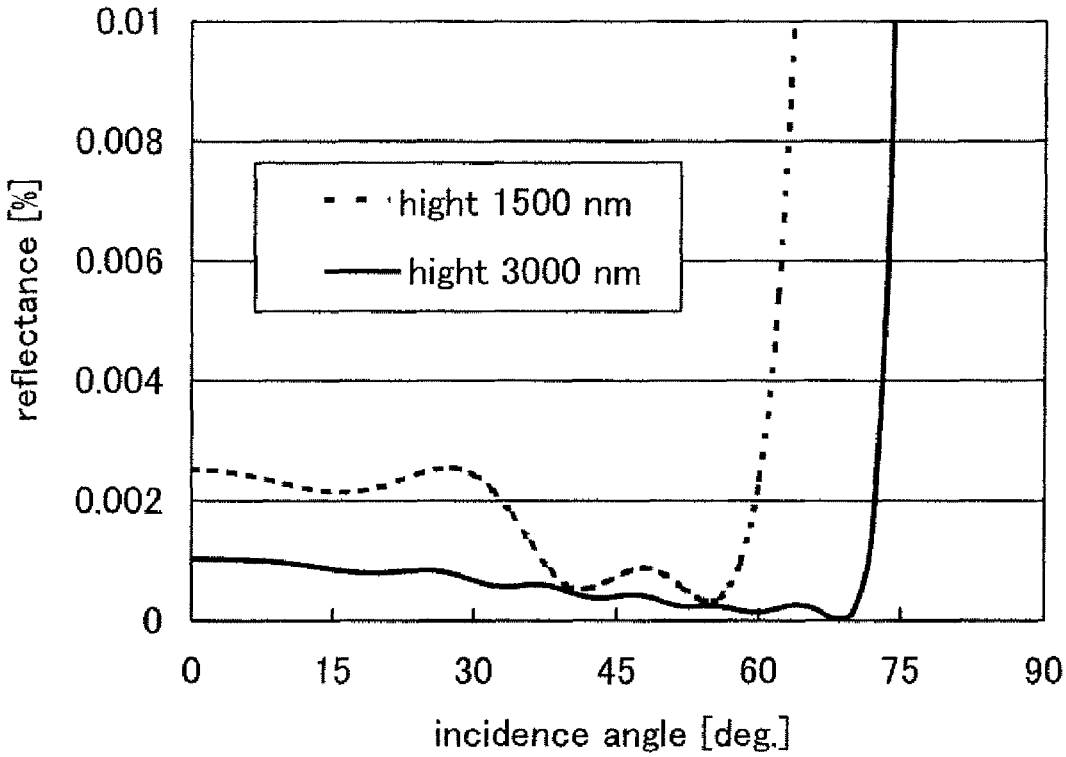
FIG. 26 is a graph showing experimental data of Embodiment Mode 1.

FIG. 26 shows the result of the optical calculations in which relationships between the incidence angle of light with a wavelength of 550 nm and reflectance of light in a model filled with hexagonal pyramid-shaped projections was calculated. Relationships between incidence angle and reflectance are for in which the wavelength of the light was 550 nm, a width of the hexagonal pyramid-shaped projection was 300 nm, and the height thereof was 1500 nm or 3000 nm. The relationship for the model in which the height was 1500 nm is shown by a dotted line and the relationship for the model in which the height was 3000 nm shown by a solid line. The reflectance was supressed to 0.003% or lower when the incidence angle was 60° or less. The reflectance was approximately 0.01% even when the incidence angle was around 75°. From these results, the model filled with the hexagonal pyramid-shaped projections of the present invention can confirm that the reflectance over a wide range of incidence angle can be reduced.

Figure 27:
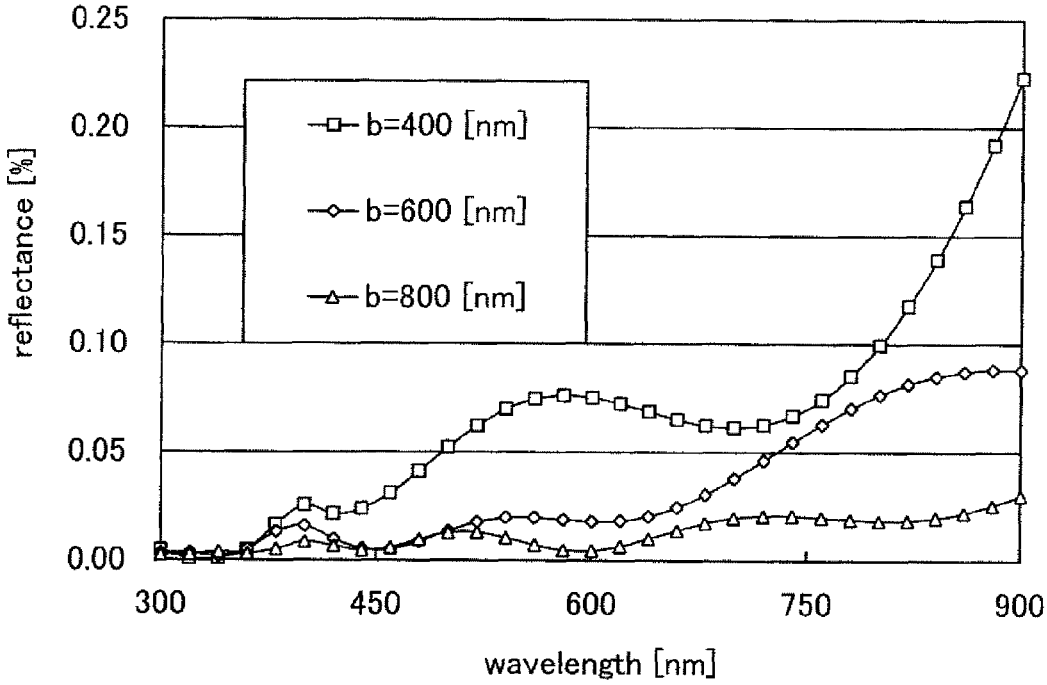
FIG. 27 is a graph showing experimental data of Embodiment Mode 1.

Similarly, the change in reflectance with respect to light in each wavelength in the model filled with the hexagonal pyramid-shaped projections was calculated by changing a width a and a height b of the hexagonal pyramid-shaped projection. FIG. 27 shows the changes in the reflectance with respect to light of each wavelength when the width a of the hexagonal projection was 300 nm and the height b thereof was changed to 400 nm (results indicated by square data markers), 600 nm (results indicated by diamond-shaped data markers), and 800 nm (results indicated by triangular data markers), respectively. The reflectance becomes lower across the measured wavelengths as the height b becomes higher, from 400 nm to 600 nm, and 800 nm. When the height b was 800 nm, dependence of the reflectance on the wavelength decreased, and the reflectance was 0.04% or less in all ranges of the measured wavelengths, which are visible light regions.

Figure 28:
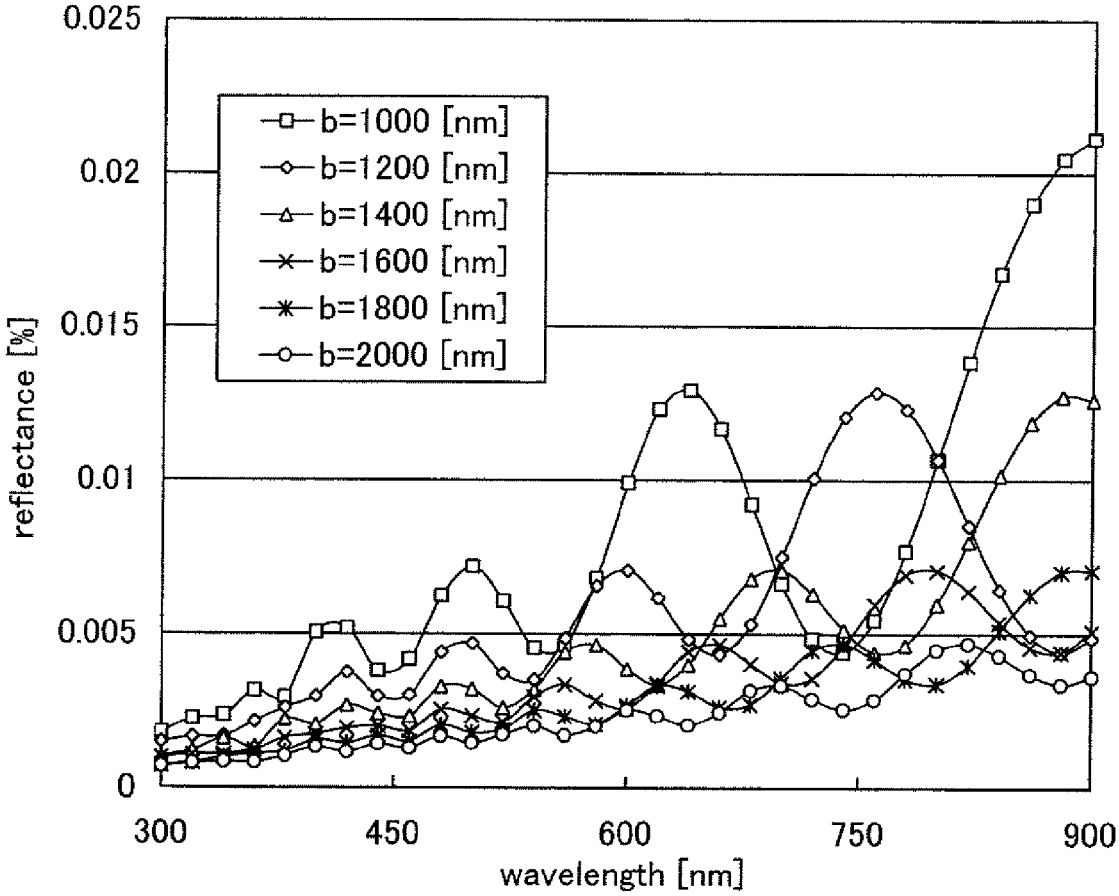
FIG. 28 is a graph showing experimental data of Embodiment Mode 1.

Further, FIG. 28 shows the results of optical calculations of the reflectance with respect to light in each wavelength when the width a of the hexagonal pyramid-shaped projection was 300 nm and the height b thereof was changed to 1000 nm (results indicated by square data markers), 1200 nm (results indicated by diamond-shaped data markers), 1400 nm (results indicated by triangular data markers), 1600 nm (results indicated by x-shaped data markers), 1800 nm (results indicated by asterisk data markers), and 2000 nm (results indicated by circular data markers). As shown in FIG. 28, when the width a was 300 nm and the height b was 1000 nm or more, the reflectance was supressed to a low value of 0.022% or lower in the measured wavelengths (300 nm to 780 nm). When the height b was 1600 nm or more, the reflectance was supressed to a low reflectance of 0.008% or less in all measured wavelengths.

Figure 29:
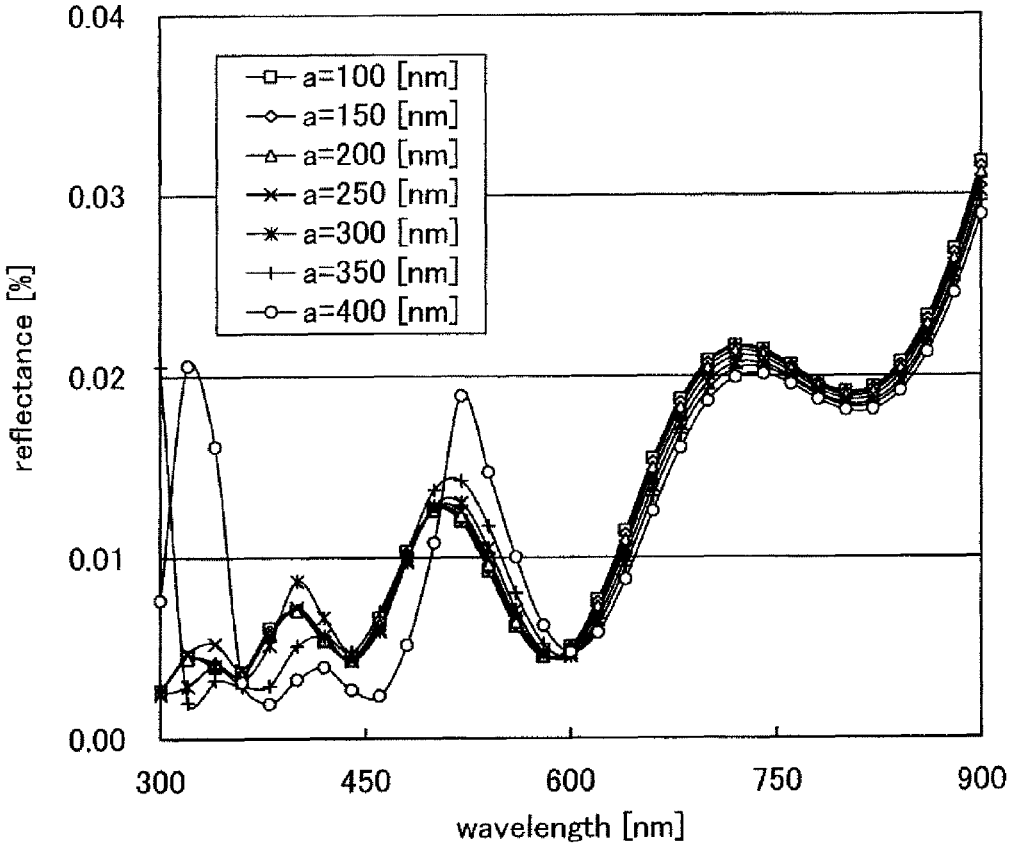
FIG. 29 is a graph showing experimental data of Embodiment Mode 1.

FIG. 29 shows the changes in reflectance with respect to light in each wavelength when the height b of the hexagonal pyramid-shaped projection was 800 nm and the width a thereof was changed to 100 mm (results indicated by square data markers), 150 nm (results indicated by diamond-shaped data markers), 200 nm (results indicated by triangular data markers), 250 nm (results indicated by x-shaped data markers), 300 nm (results indicated by asterisk data markers), 350 nm (results indicated by cross-shaped data markers), and 400 nm (results indicated by circular data markers). The reflectance becomes lower across the measured wavelengths as the width a decreased, from 400 nm to 350 nm, and 300 nm. When the width a was 350 nm or less, dependence of the reflectance on the wavelength was reduced, and the reflectance was approximately less than or equal to 0.03% in all ranges of the measured wavelengths, which are visible light regions.

Figure 30:
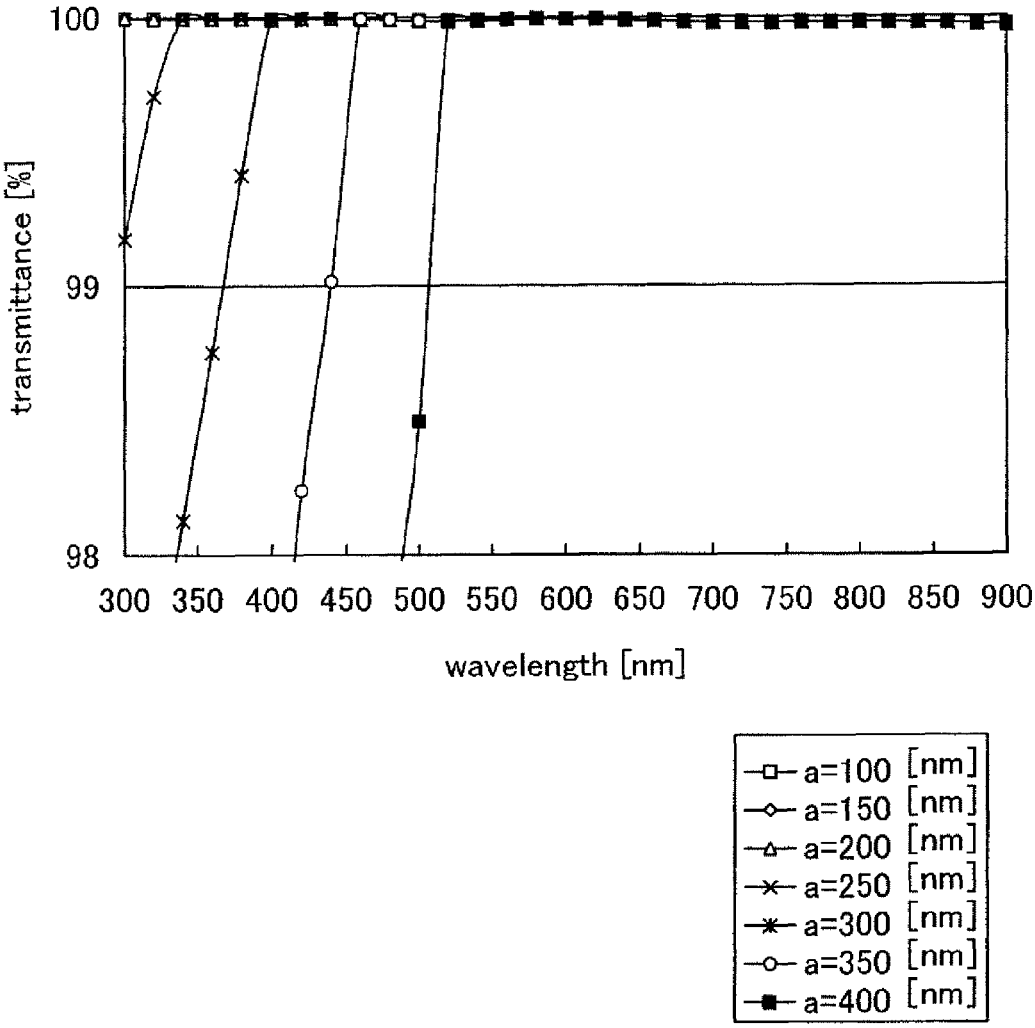
FIG. 30 is a graph showing experimental data of Embodiment Mode 1.

FIG. 30 shows the results of optical calculations of the transmittance of light in each wavelength, for light transmitted from a base side of the hexagonal pyramid-shaped projection to an apex thereof when the height b of the hexagonal pyramid-shaped projection was 800 nm and the width a was changed to 100 nm (results indicated by square data markers), 150 nm (results indicated by diamond-shaped data markers), 200 nm (results indicated by triangular data markers), 250 nm (results indicated by x-shaped data markers), 300 nm (results indicated by asterisk data markers), 350 nm (results indicated by cross-shaped data markers), and 400 nm (results indicated by circular data markers). As shown in FIG. 30, in the case where the height b was 800 nm, a wavelength for which the transmittance was 100% shifted to the short wavelength side as the width a was decreased, from 400 nm to 350 nm. When the width was 300 nm or less, light of all wavelengths of the measured wavelength regions of 300 to 780 nm was totally transmitted, and light of visible light region was sufficiently transmitted.

From the above-described results, it can be seen that an interval between apexes of the plurality of hexagonal pyramid-shaped projections is preferably 350 nm or less (more preferably, greater than or equal to 100 nm and less than or equal to 300 nm), and the height of each of the plurality of hexagonal pyramid-shaped projections is preferably 800 nm or more (more preferably, 1000 nm or more, further preferably, greater than or equal to 1600 nm and less than or equal to 2000 nm)

Figure 6A:
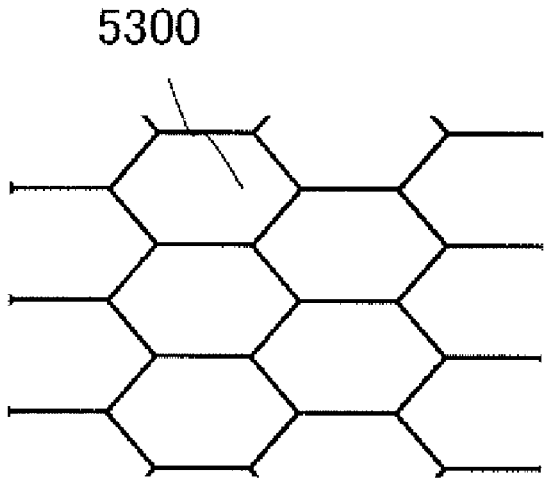
FIGS. 6A and 6B are top plan view showing a hexagonal pyramid-shaped projection to which the present invention is applicable.
Figure 6B:
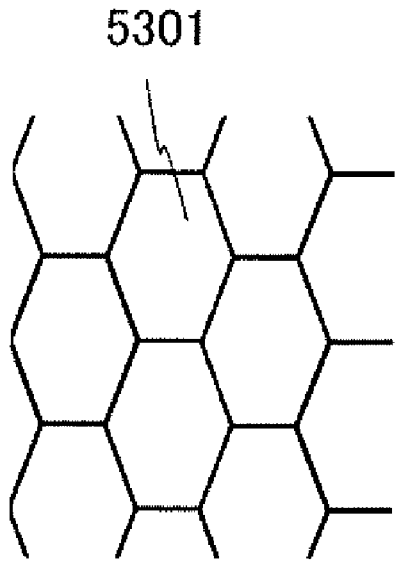
Figure 7A:
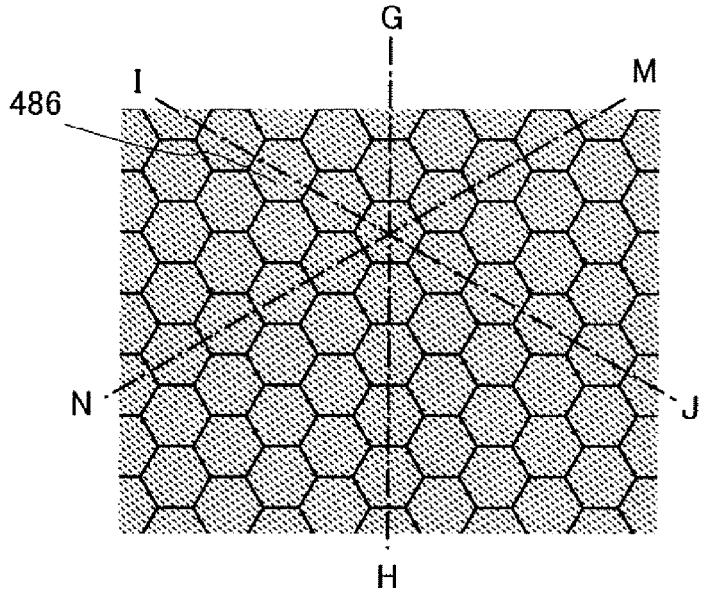
FIGS. 7A to 7D are conceptual diagrams of the present invention.
Figure 7B:
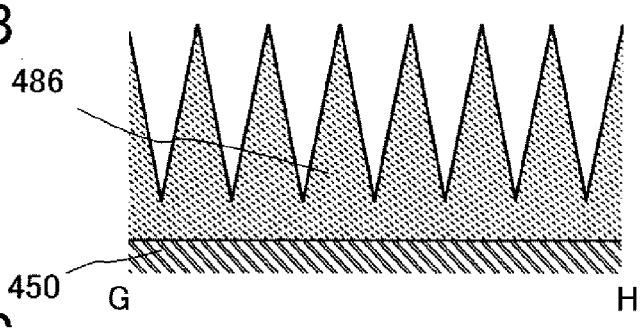
Figure 7C:
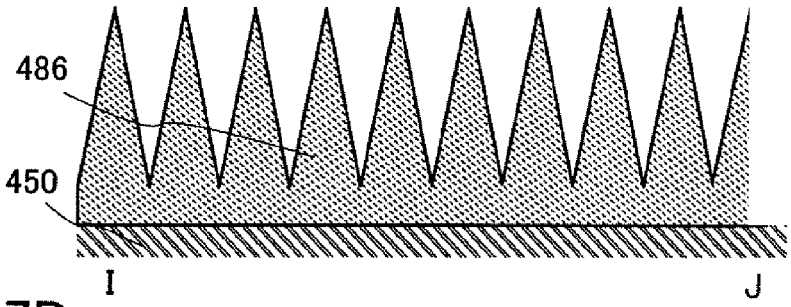
Figure 7D:
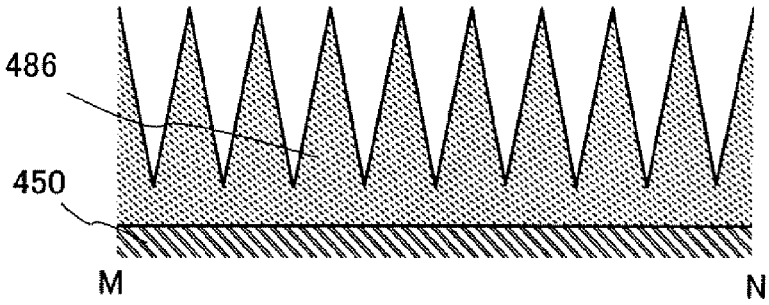

FIGS. 6A and 6B show other examples of the base of the hexagonal pyramid-shaped projection. Similarly to a hexagonal pyramid-shaped projection 5300 and a hexagonal pyramid-shaped projection 5301 shown in FIGS. 6A and 6B respectively, lengths and inner angles of all six sides do not have to be equal. Even when the hexagonal pyramid-shaped projection 5300 or the hexagonal pyramid-shaped projection 5301 is used, hexagonal pyramid-shaped projections can be adjacent to each other such that they are densely arranged without any space, and incident light from an external source can be scattered in many directions.

Figure 2A:
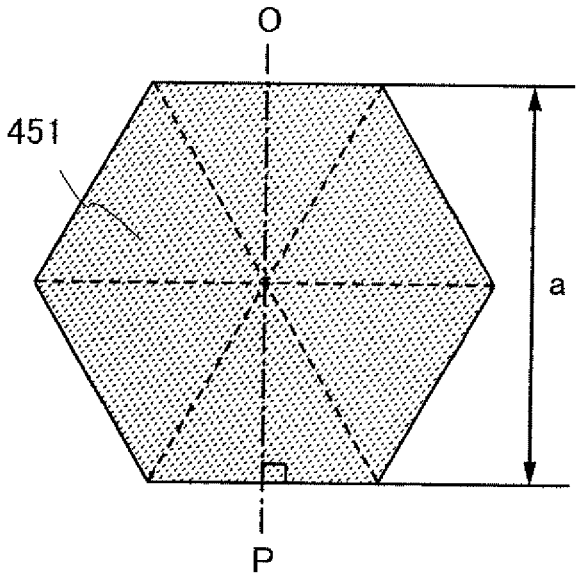
FIGS. 2A and 2B are conceptual diagrams of the present invention.
Figure 2B:
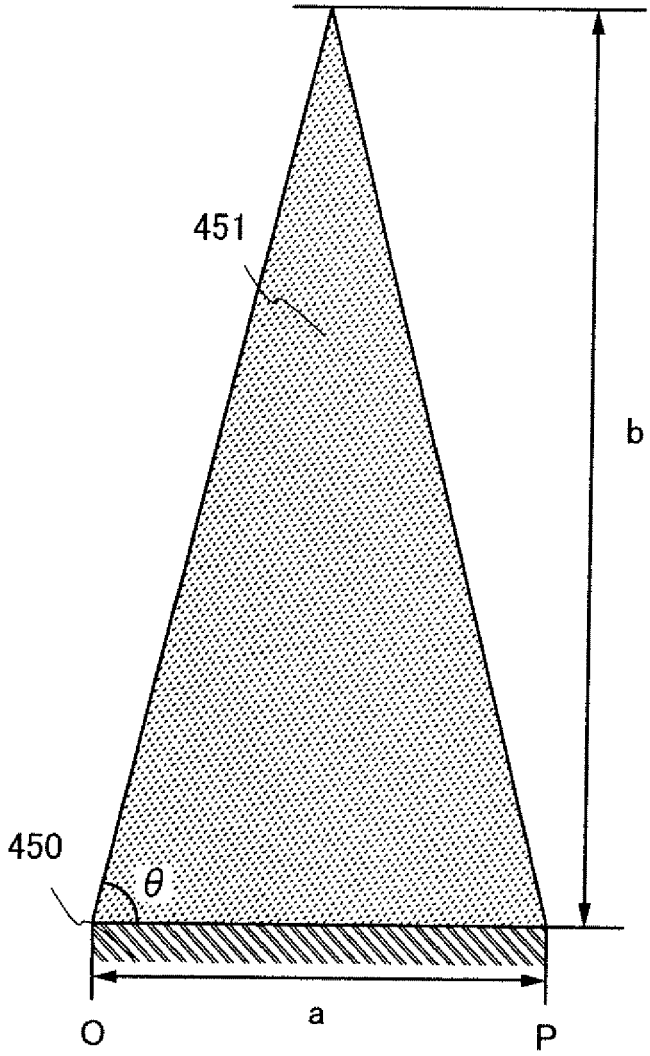

FIGS. 2A and 2B are enlarged views of the hexagonal pyramid-shaped projection shown in FIGS. 1A to 1D, which is an anti-reflection body. FIG. 2A is a top view of the hexagonal pyramid-shaped projection and FIG. 2B is a cross-sectional view taken along a line O-P in FIG. 2A. The line O-P passes through the center of a base of the hexagonal pyramid-shaped projection and is perpendicular to a side of the base. As shown in FIG. 2B, a surface of side and the base of the hexagonal pyramid-shaped projection form an angle θ in a cross section of the hexagonal pyramid-shaped projection. In this specification, the length of the line which passes through the center of the base of the hexagonal pyramid-shaped projection and is perpendicular to the side of the base of the hexagonal pyramid-shaped projection is referred to as a width a of the base of the hexagonal pyramid-shaped projection. In addition, a length from the base of the hexagonal pyramid-shaped projection to an apex thereof is referred to as a height b of the hexagonal pyramid-shaped projection.

In the hexagonal pyramid-shaped projection of this embodiment mode, a ratio between the height b of the hexagonal pyramid-shaped projection and the width a of the base thereof is preferably 5 or more.

Figure 5A:
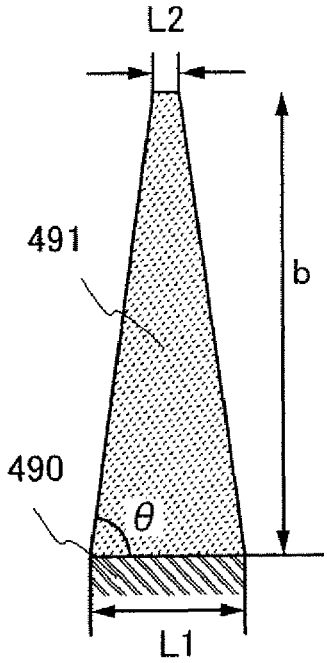
FIGS. 5A to 5C are cross-sectional views showing a hexagonal pyramid-shaped projection to which the present invention is applicable.
Figure 5B:
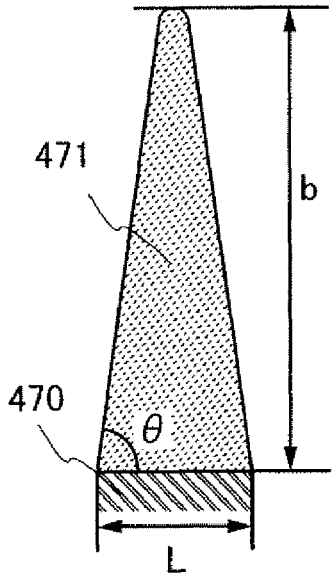
Figure 5C:
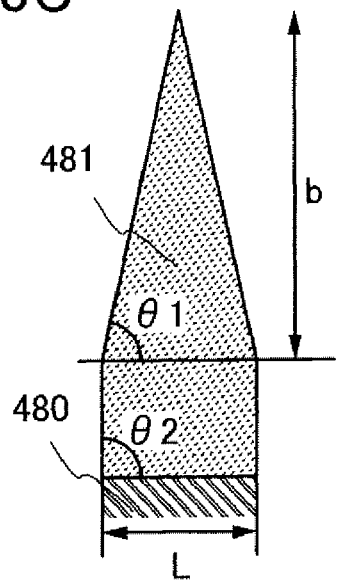

FIGS. 5A to 5C show examples of shapes of hexagonal pyramid-shaped projections. FIG. 5A shows a shape of a hexagonal pyramid-shaped projection whose end is not sharp and which has a top surface and a base. Accordingly, a cross-sectional view of a face which is perpendicular to a base is trapezoidal. In a hexagonal pyramid-shaped projection 491 provided on a surface of a substrate 490 which serves as a display screen, such as the one in FIG. 5A, a distance between a lower base and an upper base is referred to as a height b in the present invention.

FIG. 5B shows an example in which a hexagonal pyramid-shaped projection 471 with a rounded top is provided over a substrate 470 which serves as a display screen. The hexagonal pyramid-shaped projection may have a shape such as this with a rounded top and a curvature. In this case, a height b of the hexagonal pyramid-shaped projection corresponds to a distance between a base and the highest point of an apical portion.

FIG. 5C shows an example in which a hexagonal pyramid-shaped projection 481 having a surface of side of the hexagonal pyramid-shaped projection 481 which, in a cross section of the hexagonal pyramid-shaped projection 481, has a plurality of angles θ1 and θ2 with respect to a base of the hexagonal pyramid-shaped projection 481, is provided over a substrate 480 which serves as a display screen. The hexagonal pyramid-shaped projection may have a shape such as this, such that an object with the shape of a hexagonal pyramid-shaped projection (having a side angle of θ1) is stacked over an object with the shape of a hexagonal column (having a side angle of θ2). In this case, angles made by the surface of side and the base, indicated by θ1 and θ2, are different, and $0° < \theta 1 < \theta 2$. In the hexagonal pyramid-shaped projection 481 in FIG. 5C, the height b corresponds to the height of portion of the hexagonal pyramid-shaped projection which has an oblique side.

Although FIGS. 1A to 1D show the structure in which the plurality of hexagonal pyramid-shaped projections are in contact with each other on a base and are densely arranged, a structure in which a plurality of hexagonal pyramid-shaped projections in a surface which is an upper part of a film (the substrate) may also be employed. FIGS. 7A to 7D show an example in which surfaces of side of hexagonal pyramid-shaped projections in FIGS. 1A to 1D do not reach a display screen and the hexagonal pyramid-shaped projections are provided with the shape of a film 486 which has a plurality of hexagonal pyramid-shaped projections on a surface (namely, a single continuous film). The anti-reflection layer of the present invention may have any structure as long as it is one having hexagonal pyramid-shaped projections which are adjacent to each other and are densely arranged. An integrated continuous structure in which hexagonal pyramid-shaped projections are formed directly into a surface part of a film (the substrate). That is, a surface of a film (the substrate) may be processed to form hexagonal pyramid-shaped projections thereinto, for example, a shape with hexagonal pyramid-shaped projections may be selectively formed by a printing method such as nanoimprinting. Alternatively, hexagonal pyramid-shaped projections may be formed on a film (the substrate) in another step. Furthermore, the hexagonal pyramid-shaped projections may be attached to the surface of the film (the substrate) using an adhesive. Thus, the anti-reflection layer of the present invention can be formed by employing various forms having a plurality of hexagonal pyramid-shaped projections.

For the substrate provided with the hexagonal pyramid projection (namely, the substrate which serves as the display screen), a glass substrate, a quartz substrate, or the like can be used. Alternatively, a flexible substrate may be used. A flexible substrate refers to a substrate which can be bent. For example, besides a plastic substrate made of polyethylene terephthalate, polyethersulfone, polystyrene, polyethylene napthalate, polycarbonate, polyimide, polyarylate, or the like, an elastomer which is a high molecular material, or the like, with a property of plasticizing at high temperatures so that it can be shaped similarly to plastic, and a property of being an elastic body like rubber at room temperature can be used. Alternatively, a film (formed of polypropylene, polyester, vinyl, polyvinyl fluoride, vinyl chloride, polyamide or the like), a film formed by inorganic evaporation, or the like can be used.

The hexagonal pyramid-shaped projection can be formed of a material whose refractive index changes from an apical portion to the side which the substrate serving as the display screen is on instead of a material with a uniform refractive index. For example, a structure can be used in which the apical portion of each of the plurality of the hexagonal pyramid-shaped projections is formed of a material having a refractive index equivalent to that of the air, so that reflection of incident light from an external source, which enters the hexagonal pyramid-shaped projection through the air, at a surface of the hexagonal pyramid-shaped projection is further reduced. Meanwhile, when a portion closer to the substrate which serves as the display screen side is formed of a material having a refractive index equivalent to that of the substrate in each of the plurality of hexagonal pyramid-shaped projections, reflection of light which travels through the hexagonal pyramid-shaped projection and is incident on the substrate, which occurs at an interface between the hexagonal pyramid-shaped projection and the substrate, can be further reduced. When a glass substrate is used for the substrate, the refractive index of the air is smaller than that of a glass substrate. Thus, the apical portion of the hexagonal pyramid-shaped projection may have a structure such that an apical portion of the hexagonal pyramid-shaped projection is formed of a material having a lower refractive index, and a portion closer to the base of the hexagonal pyramid-shaped projection is formed of a material having a higher refractive index, that is, the refractive index increases from the apical portion to the base of the hexagonal pyramid-shaped projection.

A composition of a material used for forming the hexagonal pyramid-shaped projection may be selected as appropriate in accordance with a material of the substrate which forms a display screen as appropriate; for example, silicon, nitrogen, fluorine, oxide, nitride, fluoride, or the like may be used. As an oxide, the following can be used: silicon oxide, boric oxide, sodium oxide, magnesium oxide, aluminum oxide (alumina), potassium oxide, calcium oxide, diarsenic trioxide (arsenious oxide), strontium oxide, antimony oxide, barium oxide, indium tin oxide (ITO), zinc oxide, indium zinc oxide (IZO) in which zinc oxide is mixed in indium oxide, a conductive material in which silicon oxide is mixed in indium oxide, organic indium, organic tin, indium oxide containing tungsten oxide, indium zinc oxide containing tungsten oxide, indium oxide containing titanium oxide, indium tin oxide containing titanium oxide, or the like. As the nitride, aluminum nitride, silicon nitride, or the like can be used. As the fluoride, lithium fluoride, sodium fluoride, magnesium fluoride, calcium fluoride, lanthanum fluoride, or the like can be used. The anti-reflection layer may include one or more kinds of the above mentioned silicon, nitrogen, fluorine, oxide, nitride, and fluoride materials. A mixing ratio thereof may be set as appropriate in accordance with a ratio of components (a component ratio) of the substrate.

The hexagonal pyramid-shaped projection can be formed in a manner such that a thin film is formed by a sputtering method, a vacuum evaporation method, a PVD (physical vapor deposition) method, or a CVD (chemical vapor deposition) method such as a low-pressure CVD (LPCVD) method or a plasma CVD method, and then etched into a desired shape. Alternatively, a droplet discharge method by which a pattern can be selectively formed, a printing method by which a pattern can be transferred or drawn (a method for forming a pattern such as screen printing or offset printing), a coating method, such as a spin coating method, a dipping method, a dispenser method, a brush coating method, a spraying method, a flow coating method, or the like can be employed. Still alternatively, an imprinting technique or a nanoimprinting technique with which a nanoscale three-dimensional structure can be formed by a transfer technology can be employed. Imprinting and nanoimprinting are techniques for forming a minute three-dimensional structure without using a photolithography process.

Figure 4:
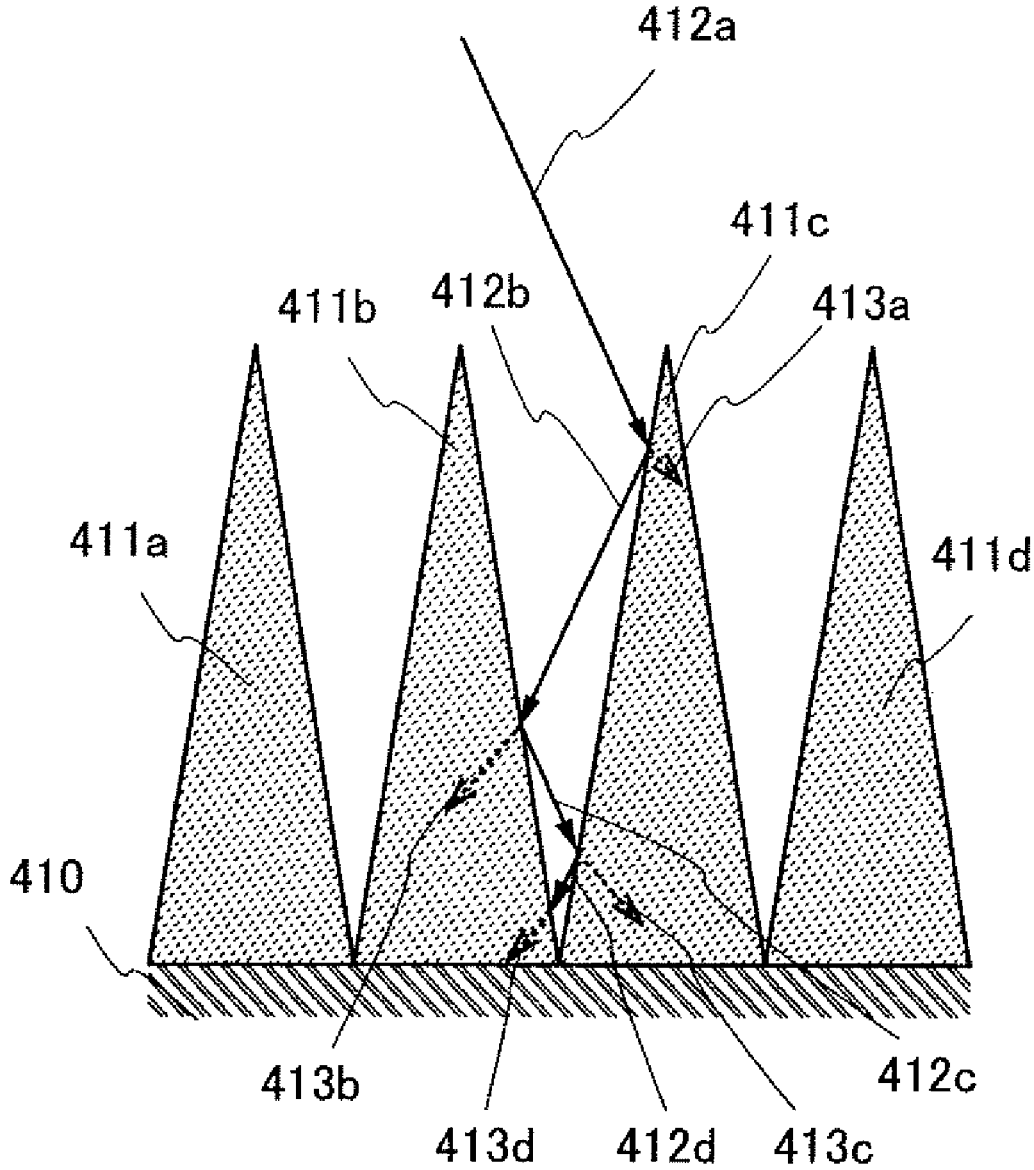
FIG. 4 is a conceptual diagram of the present invention.

The anti-reflection function of the anti-reflection layer having the plurality of hexagonal pyramid-shaped projections of the present invention is described with reference to FIG. 4. In FIG. 4, adjacent hexagonal pyramid-shaped projections 411*a*, 411*b*, 411*c*, and 411*d* are densely provided on a surface of a substrate 410 which serves as a display screen. An incident light 412*a* from external source is incident on the hexagonal pyramid-shaped projection 411*c*; part of the incident light 412*a* from an external source enters the hexagonal pyramid-shaped projection 411*c* as a transmitted light ray 413*a*; and the other part of the incident light 412*a* from external source is reflected at an interface of the hexagonal pyramid-shaped projection 411*c* as a reflected light ray 412*b*. The reflected light ray 412*h* is again incident on the hexagonal pyramid-shaped projection 411*b* which is adjacent to the hexagonal pyramid-shaped projection 411*c*; part of the incident light 412*b* from an external source enters the hexagonal pyramid-shaped projection 411*b* as a transmitted light ray 413*b*, and the other part of the incident light 412*b* from external source is reflected at an interface of the hexagonal pyramid-shaped projection 411*b* as a reflected light ray 412*c*. The reflected light ray 412*c* is again incident on the hexagonal pyramid-shaped projection 411*c* which is adjacent to the hexagonal pyramid-shaped projection 411*b*; part of the incident light 412*c* from external source enters the hexagonal pyramid-shaped projection 411*c* as a transmitted light ray 413*c*; and the other part of the incident light 412*b* from external source is reflected at an interface of the hexagonal pyramid-shaped projection 411*c* as a reflected light ray 412*d*. The reflected light ray 412*d* is again incident on the hexagonal pyramid-shaped projection 411*b* which is adjacent to the hexagonal pyramid-shaped projection 411*c*, and part of the incident light 412*b* from external source enters the hexagonal pyramid-shaped projection 411*b* as a transmitted light ray 413*d*.

As described above, the anti-reflection layer of this embodiment mode has a plurality of hexagonal pyramid-shaped projections, and a surface of side of the hexagonal pyramid-shaped projection is not parallel to the display screen, so reflected incident light from an external source is not reflected to a viewer side but rather reflected to other, adjacent, hexagonal pyramid-shaped projections. Alternatively, the reflected light travels between the hexagonal pyramid-shaped projections. Part of incident light from an external source enters an adjacent hexagonal pyramid-shaped projection and the other part of the incident light from an external source is again incident on an adjacent hexagonal pyramid-shaped projection as reflected light. In this manner, the incident light from an external source which is reflected at an interface of an adjacent hexagonal pyramid-shaped projection is repeatedly incident on other adjacent hexagonal pyramid-shaped projections.

That is, concerning incident light from an external source which is incident on the anti-reflection layer, the number of times that incident light from an external source enters the hexagonal pyramid-shaped projections of the anti-reflection layer is increased; therefore, the amount of incident light which transmits the anti-reflection layer is increased. Thus, the amount of incident light from an external source reflected to a viewer side is reduced, so a cause of reduction in visibility, such as reflection can be prevented.

The present invention can provide a PDP and an FED which are superior in visibility and which have an effective anti-reflection function capable of reducing reflection of incident light, by providing an anti-reflection layer with a plurality of adjacent hexagonal pyramid-shaped projections on a surface of the PDP or FED. Consequently, a PDP and an FED with higher image quality and performance can be manufactured.

Embodiment Mode 2

In this embodiment mode, a PDP aimed at having an anti-reflection function capable of further reducing reflection of incident light from an external source and providing excellent visibility will be described. That is, details of a structure of a PDP including a pair of substrates, a pair of electrodes interposed between the pair of substrates, a phosphor layer interposed between the pair of electrodes, and an anti-refection layer provided on an outer side of one of the pair of substrates will be described.

Figure 9:
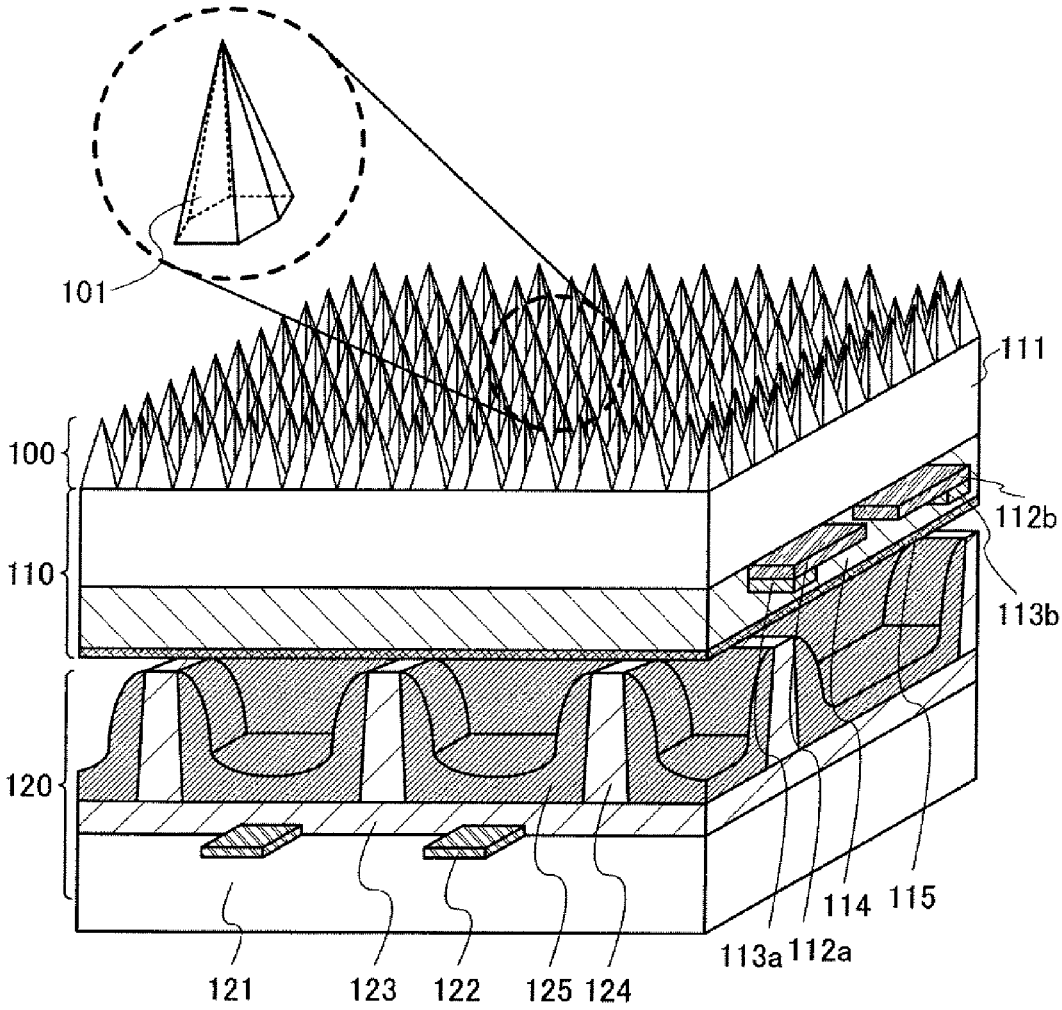
FIG. 9 is a perspective view showing a PDP of the present invention.

In this embodiment mode, a surface discharge PDP of alternating current discharge type (an AC type) is shown. As shown in FIG. 9, in a PDP, a front substrate 110 and a rear substrate 120 face each other, and the periphery of the front substrate 110 and the rear substrate 120 is sealed with a sealing material (not shown). In addition, a gap between the front substrate 110, the rear substrate 120, and the sealant is filled with a discharge gas.

Discharge cells of a display portion are arranged in matrix, and each discharge cell is arranged at an intersection of a display electrode on the front substrate 110 and an address electrode over the rear substrate 120.

In the front substrate 110, a display electrode extended in a first direction is formed on one side of a first light-transmitting substrate 111. The display electrode is formed of light-transmitting conductive layers 112*a* and 112*b*, a scan electrode 113*a*, and a sustain electrode 113*b*. A light-transmitting insulating layer 114 which covers the first light-transmitting substrate 111, the light-transmitting conductive layers 112*a* and 112*b*, the scan electrode 113*a*, and the sustain electrode 113*b* is formed. Further, a protective layer 115 is formed on the light-transmitting insulating layer 114.

On the other side of the first light-transmitting substrate 111, an anti-reflection layer 100 is formed. The anti-reflection layer 100 includes a hexagonal pyramid-shaped projection 101. For the hexagonal pyramid-shaped projection 101, the hexagonal pyramid-shaped described in Embodiment Mode 1 can be used.

Over the rear substrate 120, a data electrode 122 which is extended in a second direction intersecting at the first direction is formed over one side of a second light-transmitting substrate 121. A dielectric layer 123 which covers the second light-transmitting substrate 121 and the data electrode 122 is formed. Over the dielectric layer 123, partitions (ribs) 124 for dividing each discharge cell are formed. A phosphor layer 125 is formed in a region surrounded by the partitions (ribs) 124 and the dielectric layer 123.

A gap surrounded by the phosphor layer 125 and the protective layer 115 is filled with a discharge gas.

The first light-transmitting substrate 111 and the second light-transmitting substrate 121 can be formed using a high-strain point glass substrate which can withstand a baking process with a temperature of more than 500° C. or a soda lime glass substrate, or the like.

The light-transmitting conductive layers 112*a* and 112*b* formed on the first light-transmitting substrate 111 preferably have light-transmitting properties to transmit light emitted from a phosphor and are formed using ITO or tin oxide. The light-transmitting conductive layers 112*a* and 112*c* may be rectangular or T-shaped. The light-transmitting conductive layers 112*a* and 112*b* can be formed in a way such that a conductive layer is formed on the first light-transmitting substrate 111 by a sputtering method, an application method, or the like and then selectively etched. Alternatively, the light-transmitting conductive layers 112*a* and 112*b* can be formed in such a way that a composition is selectively applied by a droplet discharge method, a printing method, or the like and baked. Further alternatively, the light-transmitting conductive layers 112*a* and 112*b* can be formed by a lift-off method.

Each of the scan electrode 113*a* and the sustain electrode 113*b* are preferably formed of a conductive layer with a low resistance value and can be formed using chromium, copper, silver, aluminum, gold, or the like. Alternatively, a stacked-layer structure of copper, chromium, and copper or a stacked-layer structure of chromium, aluminum, and chromium can be used. As a method for forming the scan electrode 113*a* and the sustain electrode 113*b*, a similar method for forming the light-transmitting conductive layers 112*a* and 112*b* can be used as appropriate.

The light-transmitting insulating layer 114 can be formed using low melting glass containing lead or zinc. As a method for forming the light-transmitting insulating layer 114, a printing method, an application method, a green sheet laminating method, or the like is used.

The protective layer 115 is provided for protection from discharge plasma of the dielectric layer and emission promotion of secondary electrons. Therefore, a material having a low ion sputtering rate, a high secondary electron emission coefficient, a low discharge inception voltage, and a high surface insulating property is preferably used. A typical example of such a material is magnesium oxide. As a method for forming the protective layer 115, an electron beam evaporation method, a sputtering method, an ion plating method, an evaporation method, or the like can be used.

Note that a color filter and a black matrix may be provided at an interface between the first light-transmitting substrate 111 and the light-transmitting conductive layers 112*a* and 112*b*, at an interface between the light-transmitting conductive layers 112*a* and 112*b* and the light-transmitting insulating layer 114, in the light-transmitting insulating layer 114, at an interface between the light-transmitting insulating layer 114 and the protective layer 115, or the like. Providing the color filter and the black matrix makes it possible to improve contrast between light and dark and color purity of emission color of phosphor. A colored layer corresponding to an emission spectrum of a light-emission cell is provided as the color filter.

A material of the color filter includes a material in which an inorganic pigment is dispersed in light-transmitting glass having a low melting point, colored glass, a colored component of which is a metal or metal oxide, and the like. For the inorganic pigment, an iron oxide based material (red), a chromium based material (green), a vanadium-chromium based material (green), a cobalt aluminate based material (blue), or a vanadium-zirconium based material (blue) can be used. Moreover, for an inorganic pigment of the black matrix, iron-cobalt-chromium based material can be used. In addition to the inorganic pigment above, pigments can be mixed as appropriate to be used as a desired color tone of RGB or a desired color tone of the black matrix.

The data electrode 122 can be formed in a manner similar to that of the scan electrode 113*a* and the sustain electrode 113*b*.

The dielectric layer 123 is preferably white having a high reflectance so as to efficiently extract light emitted by a phosphor to the front substrate side. The dielectric layer 123 can be formed using alumina, titania, low-melting point glass containing lead or the like. As a method for forming the dielectric layer 123, a method similar to that of the light-transmitting insulating layer 114 can be used as appropriate.

The partitions (ribs) 124 are formed using ceramic and low-melting point glass containing lead. The partitions (ribs) 124 can prevent color mixture of light emitted between adjacent discharge cells and improve color purity when the partitions (ribs) 124 each have a well curb shape. As a method for forming the partitions (ribs) 124, a screen printing method, a sand blasting method, an additive method, a photosensitive paste method, a pressure forming method, or the like can be used. Although the partitions (ribs) 124 each have a well curb shape in FIG. 9, a polygon or a circle may be employed instead.

The phosphor layer 125 can be formed using various phosphors materials which can emit light by ultraviolet irradiation. For example, there are $BaMgAl_{14}O_{23}$:Eu as a phosphor material for blue, $(Y.Ga)BO_3$:Eu as a phosphor material for red, and $Zn_2SiO_4$:Mn as a phosphor material for green; however, other phosphor materials can be used as appropriate. The phosphor layer 125 can be formed by a printing method, a dispenser method, an optical adhesive method, a phosphor dry film method for laminating a dry film resist in which phosphor powder is laminated, or the like.

As a discharge gas, a mixed gas of neon and argon; a mixed gas of helium, neon and xenon; a mixed gas of helium, xenon, and krypton; or the like can be used.

Next, a method for forming the PDP is shown below.

At the periphery of the rear substrate 120, glass for sealing is printed by a printing method and then pre-baked. Next, the front substrate 110 and the rear substrate 120 are aligned, temporarily fixed, and then heated. As a result, the glass for sealing is melted and cooled, whereby the front substrate 110 and the rear substrate 120 are attached together to be panelized. Next, inside of the panel is exhausted into a vacuum while being heated. Next, after a discharge gas is introduced inside the panel from a vent pipe provided in the rear substrate 120, an open end of the vent pipe is blocked and the inside of the panel is hermetically sealed by heating the vent pipe provided in the rear substrate 120. Then, a cell of the panel is electrically discharged, and aging which continuously discharges electricity until luminescence properties and discharge characteristics become stable is performed. Thus, the panel can be completed.

Figure 10A:
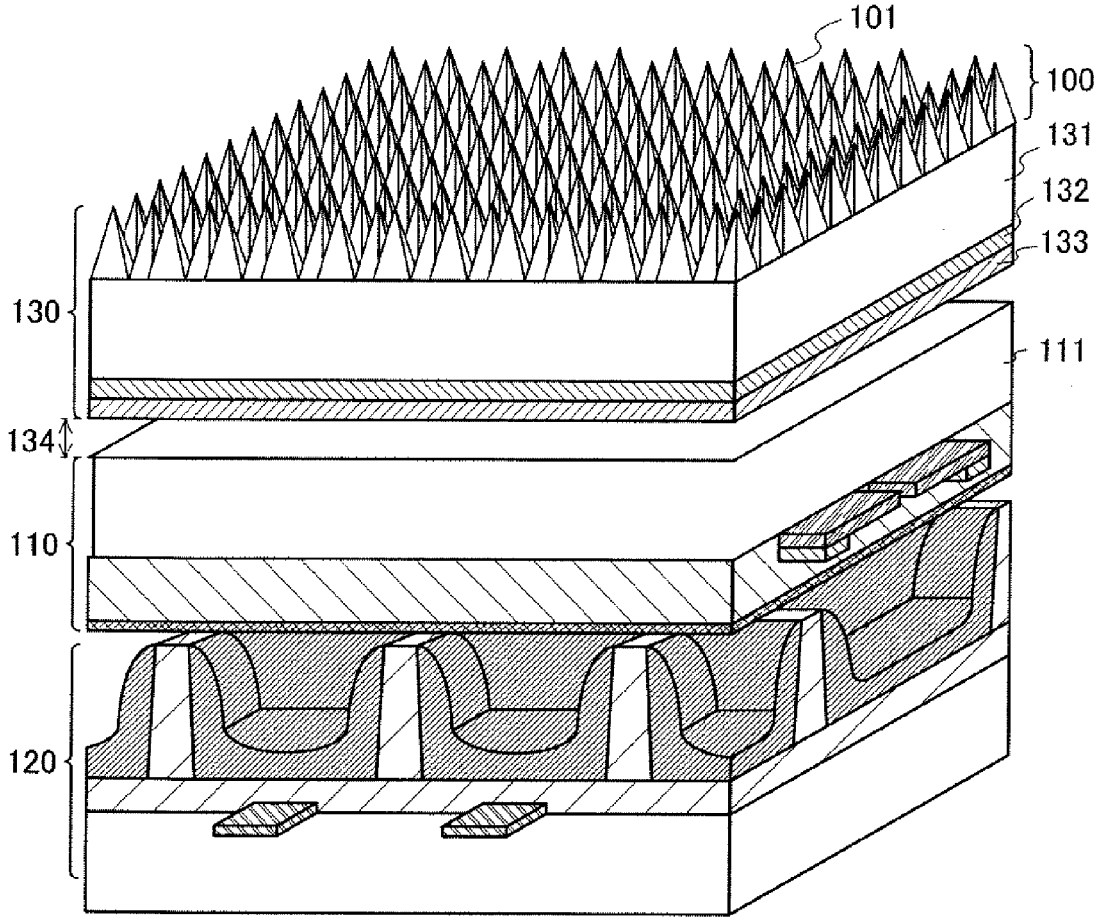
FIGS. 10A and 10B are a perspective view showing a PDP of the present invention.

As a PDP of this embodiment mode, as shown in FIG. 10A, an optical filter 130, in which an electromagnetic wave shielding layer 133 and a near-infrared ray shielding layer 132 are formed on one side of a light-transmitting substrate 131 and the anti-reflection layer 100 as described in Embodiment Mode 1 is formed on the other side of the light-transmitting substrate 131, may be formed with the front substrate 110 and the rear substrate 120 which are sealed. Note that in FIG. 1A, the mode is shown in which the anti-reflection layer 100 is not formed on a surface of the first light-transmitting substrate 111 of the front substrate 110; however, an anti-reflection layer as described in Embodiment Mode 1 may also be provided on the surface of the first light-transmitting substrate 111 of the front substrate 140. With such a structure, reflectance of incident light from an external source can be reduced further.

When plasma is generated inside of the PDP, electromagnetic waves, infrared rays, and the like are released outside of the PDP. Electromagnetic waves are harmful to human bodies. In addition, the infrared rays cause malfunction of a remote controller. Therefore, the optical filter 130 is preferably used for shielding electromagnetic waves and infrared rays.

The anti-reflection layer 100 may be formed over the light-transmitting substrate 131 by the manufacturing method described in Embodiment Mode 1. Alternatively, a surface of the light-transmitting substrate 131 may function as the anti-reflection layer 100. Still alternatively, the anti-reflection layer 100 may be attached to the light-transmitting substrate 131 using a UV curing adhesive or the like.

As a typical example of the electromagnetic wave shielding layer 133, there are metal mesh, metal fiber mesh, mesh in which an organic resin fiber is coated with a metal layer, and the like. The metal mesh and the metal fiber mesh are formed of gold, silver, platinum, palladium, copper, titanium, chromium, molybdenum, nickel, zirconium, or the like. The metal mesh can be formed by a plating method, an electroless plating method, or the like after a resist mask is formed over the light-transmitting substrate 131. Alternatively, the metal mesh can be formed in such a way that a conductive layer is formed over the light-transmitting substrate 131, and then, the conductive layer is selectively etched by using a resist mask formed by a photolithography process. A printing method, a droplet discharge method, or the like can be employed as appropriate. Note that each surface of the metal mesh, the metal fiber mesh, and the metal layer formed on a surface of the resin fiber can reduce visible light reflectance; accordingly, each surface thereof is preferably processed to be black.

An organic resin fiber, surface of which is covered with a metal layer can be formed of polyester, nylon, vinylidene chloride, aramid, vinylon, cellulose, or the like. In addition, the metal layer on the surface of the organic resin fiber can be formed using any one of the materials of the metal mesh.

As the electromagnetic wave shielding layer 133, a light-transmitting conductive layer having a surface resistance of 10Ω/□, preferably 4Ω/□, more preferably 2.5Ω/□ can be used. For the light-transmitting conductive layer, a light-transmitting conductive layer formed of ITO, tin oxide, zinc oxide, or the like can be used. The thickness of the light-transmitting conductive layer is preferably equal to or greater than 100 nm and equal to or less than 5 μm in terms of surface resistance and light-transmitting properties.

In addition, for the electromagnetic wave shielding layer 133, a light-transmitting conductive film can be used. For the light-transmitting conductive film, a plastic film in which conductive particles are dispersed can be used. As the conductive particles, there are particles of carbon, gold, silver, platinum, palladium, copper, titanium, chromium, molybdenum, nickel, zirconium, and the like.

Figure 10B:
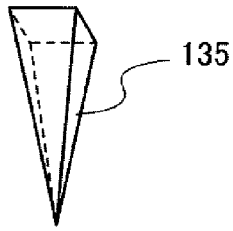

Further, as the electromagnetic wave shielding layer 133, a plurality of electromagnetic wave absorbers 135 each having a pyramid shape as shown in FIG. 10B may be provided. As the electromagnetic wave absorber, a polygonal pyramid such as a triangular pyramid, a quadrangular pyramid, a pentagonal pyramid, a hexagonal pyramid, a circular cone, or the like can be used. The electromagnetic wave absorber can be formed using a material similar to that of the light-transmitting conductive film. Further, the electromagnetic wave absorber may be formed such that a light-transmitting conductive layer formed of ITO is processed into a pyramid shape. Furthermore, the electromagnetic wave absorber may be formed in such a way that a pyramid is formed using a material similar to that of the light-transmitting conductive film and then a light-transmitting conductive layer is formed on the surface of the pyramid. Note that an apical angle of the electromagnetic wave absorber faces to the first light-transmitting substrate 111 side; therefore reflection and absorption of electromagnet waves can be increased.

Note that the electromagnetic wave shielding layer 133 may be attached to the near-infrared ray shielding layer 132 using an adhesive such as an acrylic-based adhesive, a silicon-based adhesive, a urethane-based adhesive.

Note that the electromagnetic wave shielding layer 133 is grounded at an end portion to a ground terminal.

The near-infrared ray shielding layer 132 is a layer in which one or more kinds of dyes each having a maximum absorption wavelength of 800 to 1000 nm is dissolved into an organic resin. As the dyes, there are a cyanine-based compound, a phthalocyanine-based compound, a naphthalocyanine-based compound, a naphthoquinone-based compound, an anthraquinone-based compound, a dithiol-based complex, and the like.

As an organic resin which can be used for the near-infrared ray shielding layer 132, a polyester resin, a polyurethane resin, an acrylic resin, or the like can be used as appropriate. In addition, a solvent can be used as appropriate to dissolve the dye.

As the near-infrared ray shielding layer 132, a light-transmitting conductive layer formed of a copper-based material, a phthalocyanine-based compound, zinc oxide, silver, ITO, or the like; or a nickel complex layer may be formed on the surface of the light-transmitting substrate 131. Note that in the case of forming the near-infrared ray shielding layer 132 with the material, the near-infrared ray shielding layer 132 has a thickness which transmits light and blocks near infrared light.

The near-infrared ray shielding layer 132 can be formed by applying a composition by a printing method, an application method, or the like and curing the composition by heating or light irradiation.

For the light-transmitting substrate 131, a glass substrate, a quartz substrate, a flexible substrate, or the like can be used. A flexible substrate is a substrate capable of being bent, and for example, a plastic substrate and the like formed of polyethylene terephthalate, polyethersulfone, polystyrene, polyethylene naphthalate, polycarbonate, polyimide, polyarylate, or the like are given. Alternatively, a film (formed of polypropylene, polyester, vinyl, polyvinyl fluoride, polyvinyl chloride, polyamide or the like), an inorganic vapor deposition film or the like can be used.

Figure 11:
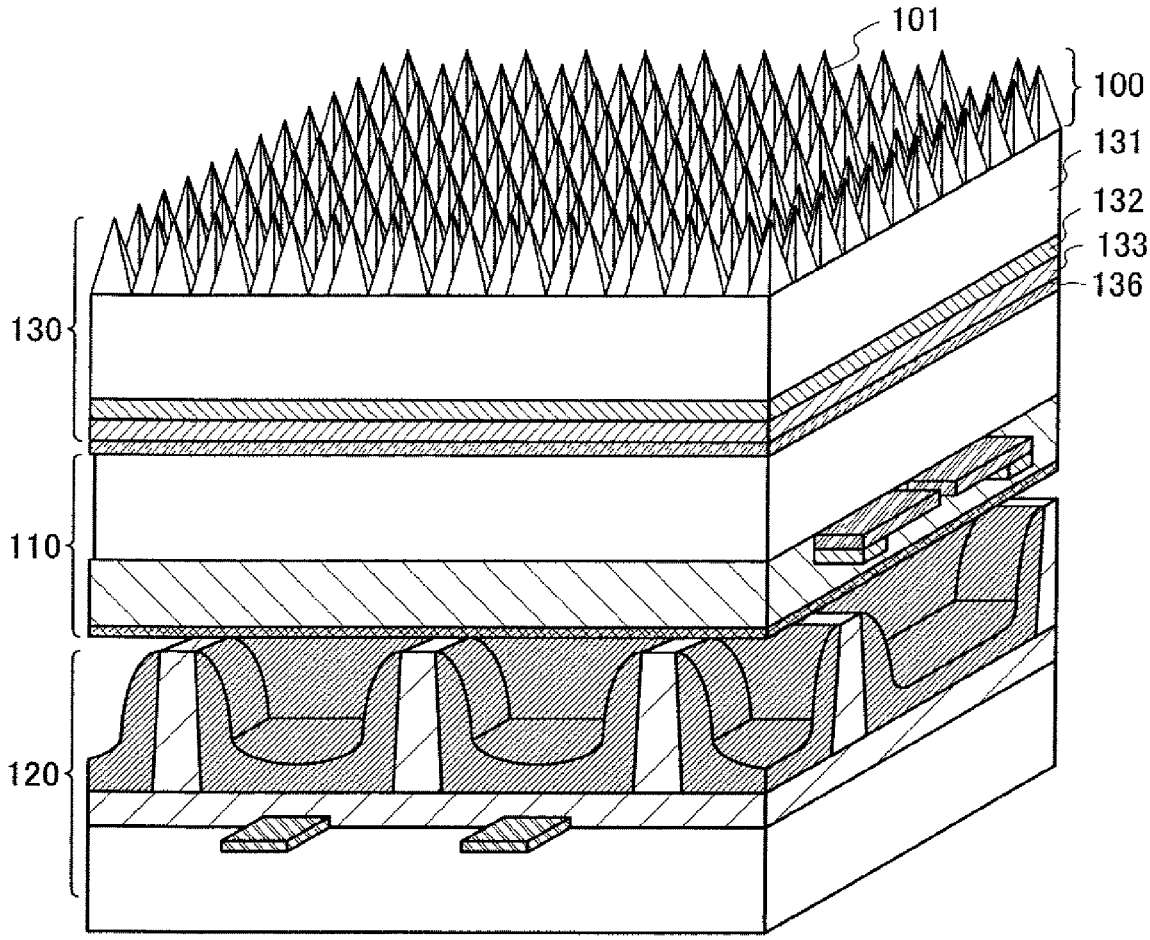
FIG. 11 is a perspective view showing a PDP of the present invention.

Note that in FIG. 10A, the front substrate 110 and the optical filter 130 are provided with a gap 134 interposed therebetween; however, as shown in FIG. 11, the optical filter 130 and the front substrate 110 may be attached together by using an adhesive 136. For the adhesive 136, an adhesive having light-transmitting properties can be used as appropriate, and typically, there are an acrylic-based adhesive, a silicon-based adhesive, a urethane-based adhesive, and the like.

In particular, using plastic for the light-transmitting substrate 131 and providing the optical filter 130 on the surface of the front substrate 110 by using the adhesive 136 make it possible to reduce thickness and weight of a plasma display.

Note that the electromagnetic wave shielding layer 133 and the near-infrared ray shielding layer 132 are formed using different layers here; however, one functional layer having an electromagnetic wave shield function and a near-infrared light shielding function may be formed instead. In this manner, the thickness of the optical filter 130 can be thinned, and reduction in weight and thickness of the PDP can be achieved.

Figure 12:
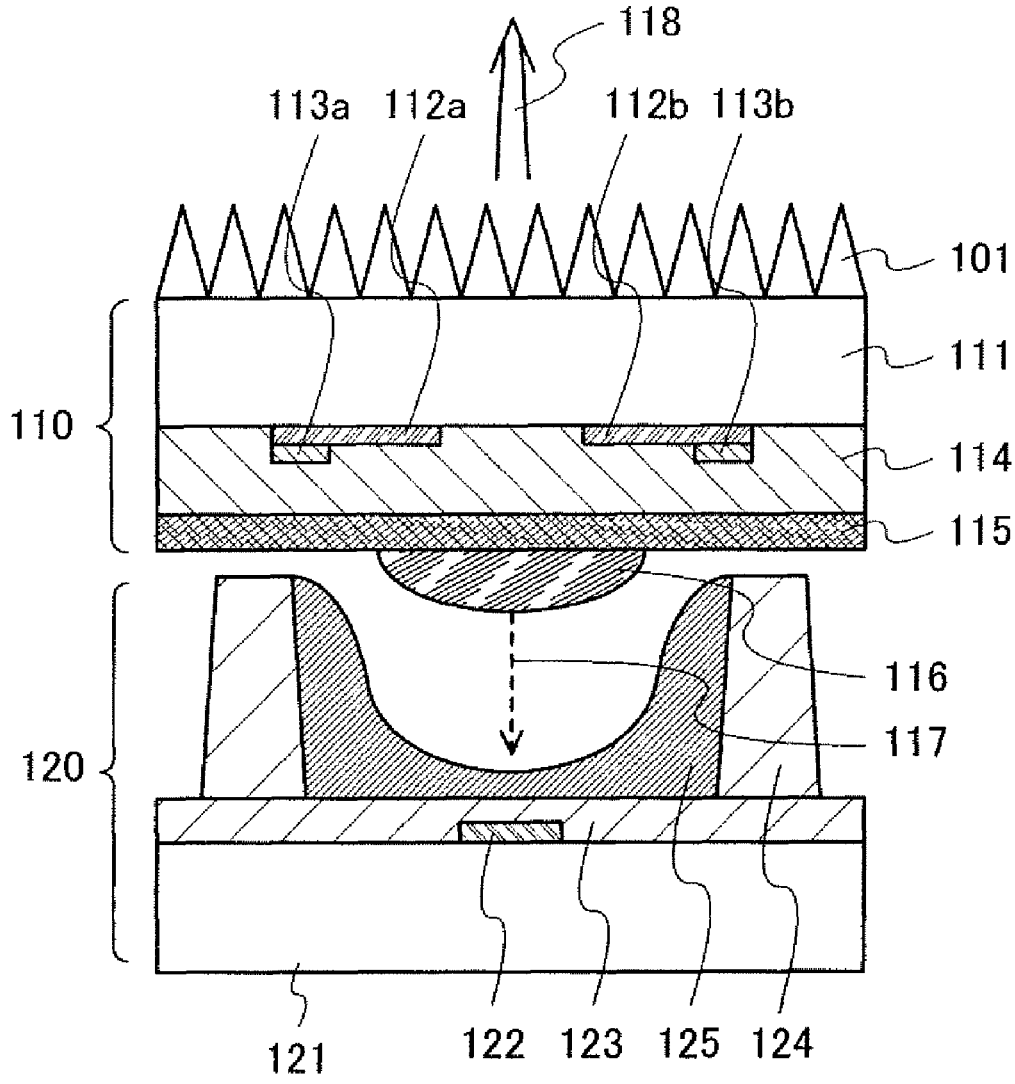
FIG. 12 is a cross-sectional view showing a PDP of the present invention.
Figure 13:
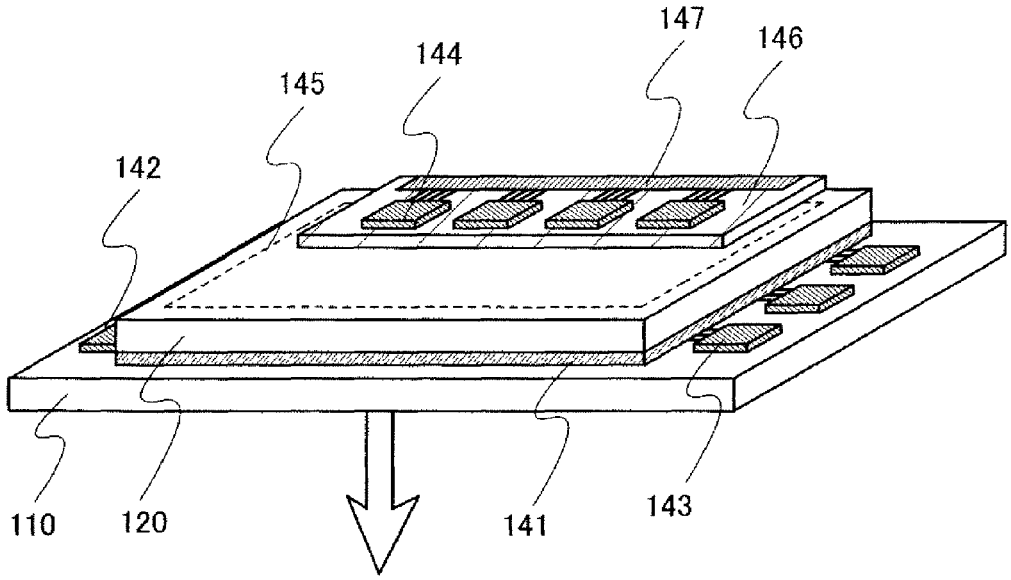
FIG. 13 is a perspective view showing a PDP module of the present invention.

Next, a PDP module and a driving method thereof are described with reference to FIGS. 12 to 14. FIG. 12 is a cross-sectional view of a discharge cell. FIG. 13 is a perspective view of a PDP module. FIG. 4 is a schematic diagram of a PDP module.

As shown in FIG. 13, in the PDP module, the periphery of the front substrate 110 and the rear substrate 120 is sealed with glass 141 for sealing. A scan electrode driver circuit 142 that drives a scan electrode and a sustain electrode driver circuit 143 that drives a sustain electrode are provided over the first light-transmitting substrate 111 which is part of the front substrate 110 and are connected to each of the electrodes.

A data electrode driver circuit 144 that drives a data electrode is provided over the second light-transmitting substrate which is part of the rear substrate 120 and is connected to the data electrode. Here, the data electrode driver circuit 144 is provided over a wiring board 146 and is connected to the data electrode through an FPC 147. Although not shown, a control circuit which controls the scan electrode driver circuit 142, the sustain electrode driver circuit 143, and the data electrode driver circuit 144 is provided over the first light-transmitting substrate 111 or the second light-transmitting substrate 121.

Figure 14:
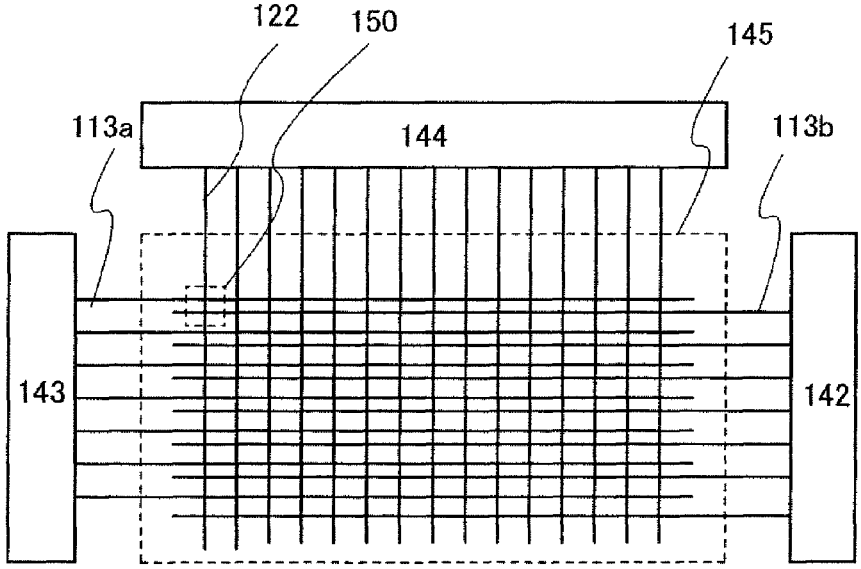
FIG. 14 is a view showing a PDP of the present invention.

As shown in FIG. 14, a discharge cell 150 of a display portion 145 is selected by a control portion based on inputted image data. Then, a pulse voltage which is equal to or higher than a discharge inception voltage is applied to the scan electrode 113*a* and the data electrode 122 of the discharge cell 150 and is discharged between the electrodes. A wall charge is accumulated on the surface of the protective layer due to the electric discharge, and a wall voltage is generated. Then, by applying a pulse voltage between display electrodes (between the scan electrode 113*a* and the sustain electrode 113*b*) to sustain the discharge, plasma 116 is generated on the front substrate 110 side as shown in FIG. 12 to sustain the discharge. When a surface of the phosphor layer 125 of the rear substrate is irradiated with ultraviolet rays 117 generated from a discharge gas in the plasma, the phosphor layer 125 is excited to make a phosphor emit light. Then the light is extracted from the front substrate side as shown by an arrow 118.

Note that since the sustain electrode 113*b* does not necessary to scan inside the display portion 145, the sustain electrode 113*b* can serve as a common electrode. In addition, with the sustain electrode serving as a common electrode, the number of driver ICs can be reduced.

As a PDP in this embodiment mode, the reflective plane discharge PDP of an AC type is shown; however, the present invention is not limited thereto. In a transmissive discharge PDP of an AC discharge type, the anti-reflection layer 100 can be provided. Further, in a PDP of a direct current (DC) discharge type, the anti-reflection layer 100 can be provided.

The PDP described in this embodiment mode includes the anti-reflection layer on its surface. The anti-reflection layer includes a plurality of hexagonal pyramid-shaped projections. A reflected light ray of incident light from an external source reflects to not a viewer side but another adjacent hexagonal pyramid-shaped projection because the side of each hexagonal pyramid-shaped projection is not perpendicular to a direction of incidence light ray. Alternatively, incidence light ray travels between an adjacent hexagonal pyramid-shaped projection. Incident light ray partly enters an adjacent hexagonal pyramid-shaped projection, and the other incident light as reflected light is then enters another adjacent hexagonal pyramid-shaped projection. In this manner, incident light from an external source reflected at an interface of a hexagonal pyramid-shaped projection repeatedly incident on other adjacent hexagonal pyramid-shaped projections.

In other words, concerning the incident light from an external source which is incident on the anti-reflection layer, the number of times that incident light from an external source enters the hexagonal pyramid-shaped projection of the PDP is increased; therefore, the amount of incident light from external source transmitted through the hexagonal pyramid-shaped projection is increased. Thus, the amount of incident light from external source reflected on a viewer side is reduced, so a cause of reduction in visibility such as reflection can be prevented.

The hexagonal pyramid-shaped projection can be formed of a material, a refractive index of which changes from an apical portion to the side which the substrate serving as the display screen is on instead of a material with a uniform refractive index. For example, a structure can be used in which the apical portion of each of the plurality of hexagonal pyramid-shaped projections is formed of a material having a refractive index equivalent to that of the air, so that reflection of incident light from an external source, which enters the hexagonal pyramid-shaped projection through the air, at a surface of the hexagonal pyramid-shaped projection is further reduced. Meanwhile a portion closer to the substrate serving as the display screen side is formed of a material having a refractive index equivalent to that of the substrate in each of the plurality of hexagonal pyramid-shaped projections, reflection of light which travels through the hexagonal pyramid-shaped projection and is incident on the substrate, which occurs at an interface between the hexagonal pyramid-shaped projection and the substrate, can be further reduced. When a glass substrate is used for the substrate, the refractive index of air is lower than that of the glass substrate. Therefore, it is only necessary that each hexagonal pyramid-shaped projection has a structure in which an apical portion thereof is formed of a material having a low refractive index and a portion closer to a base of each hexagonal pyramid-shaped projection is formed of a material having a high refractive index, that is, the refractive index increases from the apical portion to the base of each hexagonal pyramid-shaped projection.

The PDP described in this embodiment mode has a better anti-reflection function which can reduce refection of incident light by a plurality of hexagonal pyramid-shaped projections adjacent to the surface of the PDP. As a result, a PDP superior in visibility can be provided, and thus a PDP with high definition and high performance can be manufactured.

Embodiment Mode 3

In this embodiment mode, an FED aimed at having an anti-reflection function which can reduce reflection of incident light from an external source and providing excellent visibility will be described. That is, details of a structure of FED including a pair of substrates, a field emission element provided for one of the pair of substrates, an electrode provided for the other pair of substrates, a phosphor layer which is in contact with the electrode, and an anti-reflection layer provided on an outer side of the other substrate will be described.

A FED is a display in which a phosphor is exited by an electron beam to emit light. A FED can be classified into a diode FED, a triode FED, and a tetrode FED according to the structure of electrodes.

The diode FED has a structure in which a rectangular cathode electrode is formed on a surface of a first electrode, a rectangular anode electrode is formed on a surface of a second substrate, and the cathode electrode and the anode electrode are orthogonal to each other at a distance of several μm to several mm. Potential difference between the cathode and the anode is set at 10 kV or less at an intersection between the cathode and anode passing through a vacuum space, and electron beam is emitted between the electrodes. Electrons of the electron beam reach the phosphor layer with which is provided the anode electrode and excite the phosphor and the phosphor layer emits light; therefore, an image can be displayed.

A triode FED has a structure in which a gate electrode which is orthogonal to a cathode electrode with an insulating film interposed therebetween is formed over a first substrate over which the cathode electrode is formed. The cathode electrode and the gate electrode are arranged in rectangular or in matrix, and an electron emissive element is formed at a portion in which the cathode electrode and the gate electrode intersect with each other with the insulating film interposed therebetween. By applying voltages to the cathode electrode and the gate electrode, an electron beam is emitted from the electron emissive element. This electron beam is pulled toward the anode electrode of the second substrate to which a voltage higher than a voltage of the gate electrode is applied, whereby the phosphor layer provided to the anode electrode is excited and emits light; therefore, image can be displayed.

A tetrode FED has a structure in which a placoid or thin film convergent electrode is formed between a gate electrode and an anode electrode of a triode FED, and the convergent electrode has an opening in each pixel. By converging electron beams emitted from a electron emissive element by each pixel using the converging electrode, the phosphor layer with which provided the anode electrode is excited and emits light; therefore, an image can be displayed.

Figure 15:
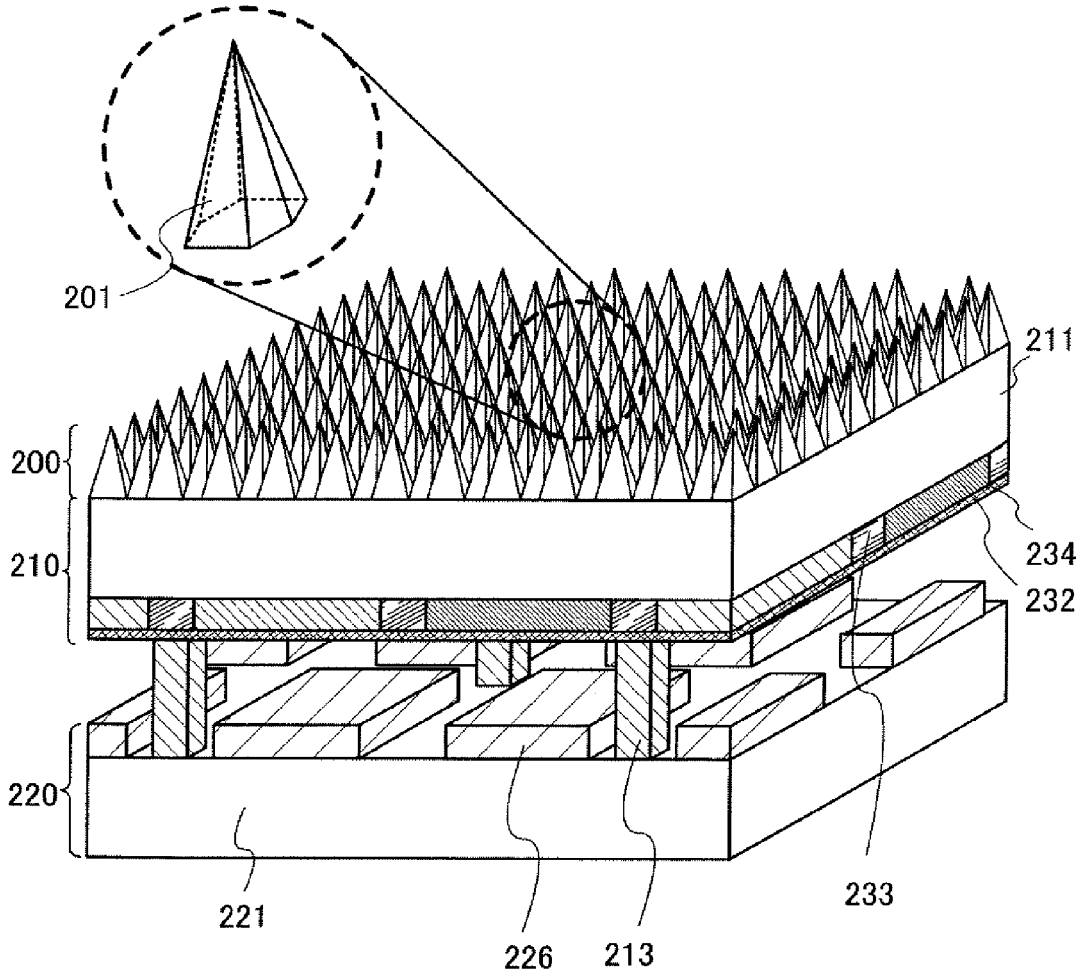
FIG. 15 is a perspective view showing an FED of the present invention.

FIG. 15 is a perspective view of an FED. As shown in FIG. 15, a front substrate 210 and a rear substrate 220 face each other, and the periphery of the front substrate 210 and the rear substrate 220 are sealed with a sealant (not shown). For a regular interval between the front substrate 210 and the rear substrate 220, a spacer 213 is provided therebetween. In addition, a closed region of the front substrate 210, the rear substrate 220, and the sealing material is held in a vacuum. When an electron beam moves between the closed region, a phosphor layer 232 attached to a metal back or an anode electrode is excited to emit light so that a given cell emits light; therefore, a display image is obtained.

The discharge cells of a display portion are arranged in matrix.

In the front substrate 210, the phosphor layer 232 is formed on one side of a first light-transmitting substrate 211. A metal back 234 is formed on the phosphor layer 232. Note that the anode electrode may be formed between the first light-transmitting substrate 211 and the phosphor layer 232. As the anode electrode, a rectangular conductive layer which extends in a first direction can be formed.

An anti-reflection layer 200 is formed on the other surface of the first light-transmitting substrate 211. The anti-reflection layer 200 includes a hexagonal pyramid-shaped projection 201. As the hexagonal pyramid-shaped projection 201, the hexagonal pyramid-shaped projection described in Embodiment Mode 1 can be used.

In the rear substrate 220, an electron emissive element 226 is formed on one side of a second light-transmitting substrate 221. As the electron emissive element, various structures are proposed. Specifically, there are a Spindt-type electron emissive element, a surface-conduction electron emissive element, a ballistic-electron surface-emission-type electron emissive element, a MIM (metal-insulator-metal) element, a carbon nanotube, graphite nanofiber, diamond-like carbon (DLC), and the like.

Figure 18A:
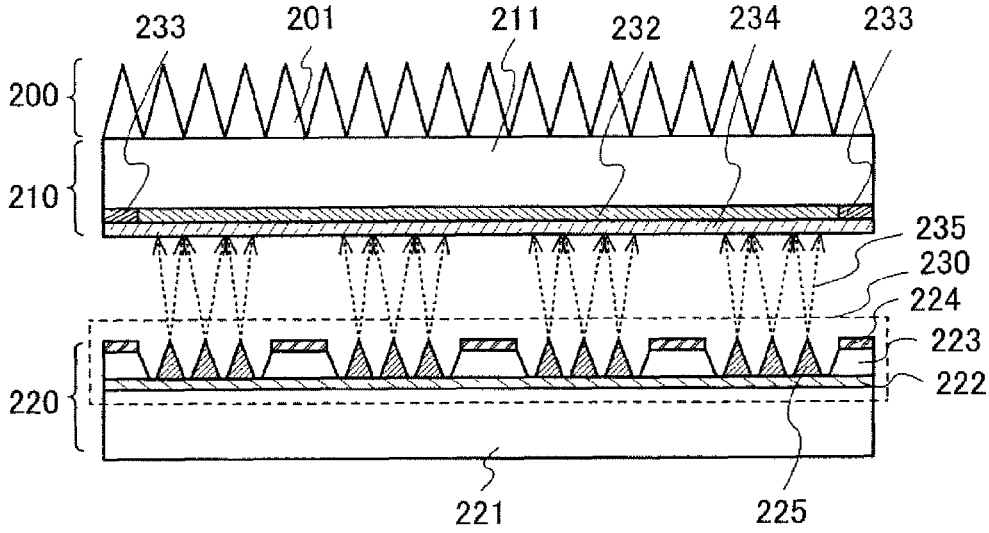
FIGS. 18A and 18B are cross-sectional views showing an FED of the present invention.
Figure 18B:
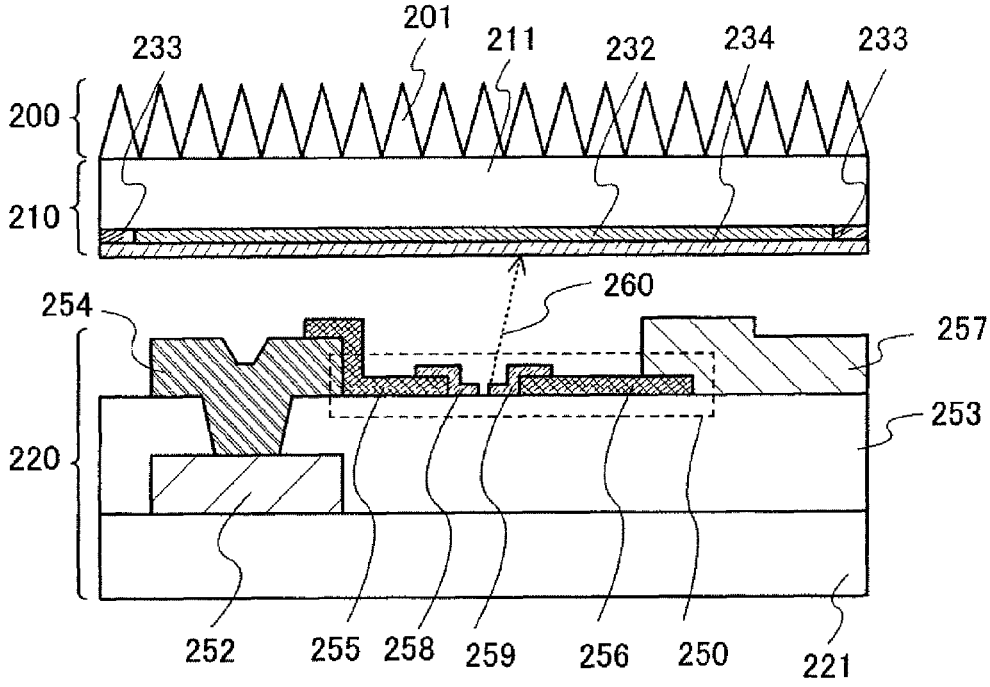

Here, a typical electron emissive element is shown with reference to FIGS. 18A and 18B.

FIG. 18A is a cross-sectional view of a cell of an FED having a Spindt-type electron emissive element.

A Spindt-type electron emissive element 230 is formed such that a cathode electrode 222 and a cone-shaped electron source 225 which are formed over the cathode electrode 222 are included. The cone-shaped electron source 225 is formed of a metal or a semiconductor. A gate electrode 224 is arranged at the periphery of the cone-shaped electron source 225. Note that the gate electrode 224 and the cathode electrode 222 are insulated from each other with an interlayer insulating layer 223 interposed therebetween.

When a voltage is applied between the gate electrode 224 and the cathode electrode 222 formed in the rear substrate 220, an electric field concentrates on a tip portion of the cone-shaped electron source 225 to be an intense electric field, so that an electron is discharged into a vacuum from the metal or the semiconductor which forms the cone-shaped electron source 225 by an tunneling effect. As to the front substrate 210, the metal back 234 (or the anode electrode) and the phosphor layer 232 are formed on the front substrate 210. By applying a voltage to the metal back 234 (or the anode electrode), an electron beam 235 emitted from the cone-shaped electron source 225 is guided to the phosphor layer 232, and a phosphor is excited to obtain light emission. Therefore, when the cone-shaped electron source 225 surrounded by the gate electrodes 224 are arranged in matrix, and a voltage is applied as selected to the cathode electrode, the metal back (or the anode electrode), and the gate electrodes, light emission of each cell can be controlled.

The Spindt-type electron emissive element has advantages in that electron extraction efficiency is high because it has a structure where an electron emissive element is arranged in a central region of a gate electrode with the largest concentration of an electric field, in-plane uniformity of an extraction current of an electron emissive element is high because patterns of the arrangement of the electron emissive elements can be accurately drawn to set suitable distribution of the electric field, and the like.

Next, a structure of a cell having a Spindt-type electron emissive element is shown. The front substrate 210 includes the first light-transmitting substrate 211, the phosphor layer 232 and a black matrix 233 formed on the first light-transmitting substrate 211, and the metal back 234 formed on the phosphor layer 232 and the black matrix 233.

As the first light-transmitting substrate 211, a substrate similar to the first light-transmitting substrate 111 described in Embodiment Mode 2 can be used.

For the phosphor layer 232, a phosphor material excited by the electron beam 235 can be used. Further, as the phosphor layer 232, phosphor layers of R, G, and B are arranged in rectangular arrangement, grid arrangement, and delta arrangement, respectively, thereby color display is performed. As a typical example, $Y_2O_2S$: Eu (red), $Zn_2SiO_4$: Mn (green), ZnS: Ag, Al (blue), or the like can be used. Note that a phosphor material which is excited by a known electron beam can also be used.

The black matrix 233 is formed between the respective phosphor layers 232. By providing the black matrix 233, discrepancy in luminous color due to misalignment of an irradiated position of the electron beam 235 can be prevented. Further, by the black matrix 233 with conductivity, charge up of the phosphor layer 232 due to an electron beam 235 can be prevented. For forming the black matrix 233, carbon particles can be used. Note that a known black matrix material for an FED can also be used.

The phosphor layer 232 and the black matrix 233 can be formed using a slurry method or a printing method. A slurry method is a method where a composition in which the phosphor material or carbon particles are mixed into a photosensitive material, a solvent, or the like is applied by spin coating and dried, and then exposed and developed.

The metal back 234 can be formed using a conductive thin film of aluminum or the like having a thickness of 10 to 200 nm, preferably a thickness of 50 to 150 nm. By providing the metal back 234, light ray emitted from the phosphor layer 232 which goes to the rear substrate 220 side is reflected on the first light-transmitting substrate 211, so that luminance can be improved. In addition, the metal back 234 can prevent the phosphor layer 232 from being damaged by shock of ions generated by ionizing a gas which remains in a cell by the electron beam 235. The electron beam 235 can be guided to the phosphor layer 232 because the metal back 234 serves as an anode electrode with respect to the electron emissive element 230. The metal back 234 can be formed in such a manner that a conductive layer is formed by a sputtering method and then selectively etched.

The rear substrate 220 includes the second light-transmitting substrate 221; the cathode electrode 222 formed over the second light-transmitting substrate 221; the cone-shaped electron source 225 formed over the cathode electrode 222; the interlayer insulating layer 223 which separates the electron source 225 into each cell, and the gate electrode 224 formed over the interlayer insulating layer 223.

As the second light-transmitting substrate 221, a substrate similar to the second light-transmitting substrate 121 as described in Embodiment Mode 2 can be used.

The cathode electrode 222 can be formed using tungsten, molybdenum, niobium, tantalum, titanium, chromium, aluminum, copper, or ITO. As a method for forming the cathode electrode 222, an electron beam evaporation method, a thermal deposition method, a printing method, an electroplating method, or the like can be used. Alternatively, a conductive layer is formed over an entire surface by a sputtering method, a CVD method, an ion plating method, or the like, and then, the conductive layer is selectively etched using a resist mask or the like, so that the cathode electrode 222 can be formed. When an anode electrode is formed, the cathode electrode can be formed of a rectangular conductive layer which extends in the first direction parallel to the anode electrode.

The electron source 225 can be formed of tungsten, tungsten alloy, molybdenum, molybdenum alloy, niobium, niobium alloy, tantalum, tantalum alloy, titanium, titanium alloy, chromium, chromium alloy, silicon which imparts n-type conductivity (doped with phosphorus), or the like.

The interlayer insulating layer 223 can be formed using the following: an inorganic siloxane polymer including a Si—O—Si bond among compounds including silicon, oxygen, and hydrogen formed using a siloxane polymer-based material as a starting material, which is typified by silica glass; or an organic siloxane polymer in which hydrogen bonded to silicon is substituted by an organic group such as methyl or phenyl, which is typified by an alkylsiloxane polymer, an alkylsilsesquioxane polymer, a silsesquioxane hydride polymer, or an alkylsilsesquioxane hydride polymer. When the interlayer insulating layer 223 is formed using the above material, an application method, a printing method, or the like is used. Alternatively, as the interlayer insulating layer 223, a silicon oxide layer may be formed by a sputtering method, a CVD method, or the like. Note that in a region where the electron source 225 is formed, the interlayer insulating layer 223 is provided with an opening.

The gate electrode 224 can be formed using tungsten, molybdenum, niobium, tantalum, chromium, aluminum, copper, or the like. As a method for forming the gate electrode 224, the method for forming the cathode electrode 222 can be used as appropriate. The gate electrode 224 can be formed of a rectangular conductive layer which extends in the second direction that intersects with the first direction at 90°. Note that in a region where the electron source 225 is formed, the gate electrode is provided with an opening.

Note that in a gap between the gate electrode 224 and the metal back 234, that is, in a gap between the front substrate 210 and the rear substrate 220, a converging electrode may be formed. The converging electrode is provided so as to focus an electron beam emitted from the electron emissive element. By providing the converging electrode, emission luminance of a light-emitting cell can be improved, and reduction in contrast due to color mixture of adjacent cells can be suppressed. A negative voltage is preferably applied to the converging electrode, compared to the metal back (or the anode electrode).

Next, a structure of a cell of an FED having a surface-conduction electron emissive element is described. FIG. 18B is a cross-sectional view of a cell of an FED having a surface-conduction electron emissive element.

A surface-conduction electron emissive element 250 is formed of element electrodes 255 and 256 which face each other, and conductive layers 258 and 259 which are in contact with the element electrodes 255 and 256 respectively. The conductive layers 258 and 259 have a gap. When a voltage is applied to the element electrodes 255 and 256, an intense electric field is generated in the gap, and electrons are emitted from one of the conductive layers to the other due to a tunneling effect. By applying a positive voltage to the metal back 234 (or the anode electrode) formed on the front substrate 210, the electrons emitted from one of the conductive layers to the other is guided to the phosphor layer 232. When this electron beam 260 excites a phosphor, light emission can be obtained.

Therefore, surface-conduction electron emissive elements are arranged in matrix, and a voltage is selectively applied to the element electrodes 255 and 256 and the metal back 234 (or the anode electrode), whereby light emission of each cell can be controlled.

A drive voltage of the surface-conduction electron emissive element is lower than other electron emissive elements; accordingly, power consumption of the FED can be lowered.

Next, a structure of the cell having the surface-conduction electron emissive element is described. The front substrate 210 includes the first light-transmitting substrate 211, the phosphor layer 232 and the black matrix 233 formed on the first light-transmitting substrate 211, and the metal back 234 formed on the phosphor layer 232 and the black matrix 233. Note that the anode electrode may be formed between the first light-transmitting substrate 211 and the phosphor layer 232. As the anode electrode, a rectangular conductive layer which extends in the first direction can be formed.

The rear substrate 220 includes the second light-transmitting substrate 221; a row-direction wiring 252 formed over the second light-transmitting substrate 221; an interlayer insulating layer 253 formed over the row direction wiring 252 and the second light-transmitting substrate 221; a connection wiring 254 connected to the row-direction wiring 252 with the interlayer insulating layer 253 interposed therebetween; the element electrode 255 which is connected to the connection wiring 254 and formed over the interlayer insulating layer 253; the element electrode 256 formed over the interlayer insulating layer 253; a column-direction wiring 257 connected to the element electrode 256; the conductive layer 258 which is in contact with the element electrode 255; and the conductive layer 259 which is in contact with the element electrode 256. Note that the electron emissive element 250 shown in FIG. 18B is formed of a pair of the element electrodes 255 and 256 and a pair of the conductive layers 258 and 259.

The row-direction wiring 252 can be formed using metal such as titanium, nickel, gold, silver, copper, aluminum, platinum; or alloy thereof. A method for forming the row direction wiring 252, a droplet discharge method, a vacuum evaporation method, a printing method, or the like can be used. Alternatively, the row direction wiring 252 can be formed in such a manner that a conductive layer formed by a sputtering method, a CVD method, or the like is selectively etched. The thickness of each of the element electrodes 255 and 256 is preferably 20 to 500 nm.

As the interlayer insulating layer 253, a material and a formation method similar to those of the interlayer insulating layer 223 shown in FIG. 18A can be used as appropriate. The thickness of the interlayer insulating layer 253 is preferably 500 nm to 5 μm.

As the connection wiring 254, a material and a formation method similar to those of the row direction wiring 252 can be used as appropriate.

The pair of the element electrodes 255 and 256 can be formed of metal such as chromium, copper, iridium, molybdenum, palladium, platinum, titanium, tantalum, tungsten, or zirconium; or an alloy thereof. As a method for forming the element electrodes 255 and 256, a droplet discharge method, a vacuum evaporation method, a printing method, or the like can be used. The element electrodes 255 and 256 can be formed in such a manner that a conductive layer formed by a sputtering method, a CVD method, or the like is selectively etched. The thickness of the element electrodes 255 and 256 is preferably 20 to 500 nm.

As the column direction wiring 257, a material and a formation method similar to those of the row direction wiring 252 can be used as appropriate.

For a material of the pair of the conductive layers 258 and 259, metal such as palladium, platinum, chromium, titanium, copper, tantalum, or tungsten; oxide such as palladium oxide, tin oxide, a compound of indium oxide and antimony oxide; silicon; carbon; or the like can be used as appropriate. Alternatively, a stacked-layer structure using a plurality of the above materials may be employed. The conductive layers 258 and 259 can be formed using particles of the above material. Note that an oxide layer may be formed at the periphery of the particles of the above material. Using particles having an oxide layer makes it possible to accelerate the mobility of electrons and to emit the electrons easily. As a method for forming the conductive layers 258 and 259, a droplet discharge method, a vacuum evaporation method, a printing method, or the like can be used. The thickness of each of the conductive layers 258 and 259 is preferably 0.1 to 50 nm.

The distance of a gap portion formed between the pair of the conductive layers 258 and 259 is preferably 100 nm or less, more preferably, 50 nm or less. The gap portion can be formed by cleavage due to application of a voltage to the conductive layers 258 and 259 or cleavage by a focused ion beam. Further, the gap portion can be formed by etching as selected, such as wet etching or dry etching using a resist mask.

Note that a converging electrode may be formed in a gap between the front substrate 210 and the rear substrate 220. Providing the converging electrode makes it possible to focus an electron beam emitted from the electron emissive element, whereby emission luminance of the cell can be improved, reduction in contrast due to color mixture of adjacent cells can be suppressed. A negative voltage is preferably applied to the converging electrode, compared to the metal back 234 (or the anode electrode).

Next, a method for forming an FED panel is described below.

At the periphery of the rear substrate 220, glass for sealing is printed by a printing method and then pre-baked. Next, the front substrate 210 and the rear substrate 220 are aligned, temporally fixed, and then heated. As a result, the glass for sealing is melted and cooled, and thus the front substrate 210 and the rear substrate 220 are attached together to be panelized. Next, inside of a panel is exhausted into a vacuum while being heated. After that, an open end of the vent pipe is blocked and the inside of the panel is vacuum sealed by heating the vent pipe provided in the rear substrate 120. Consequently, the FED panel can be completed.

Figure 16:
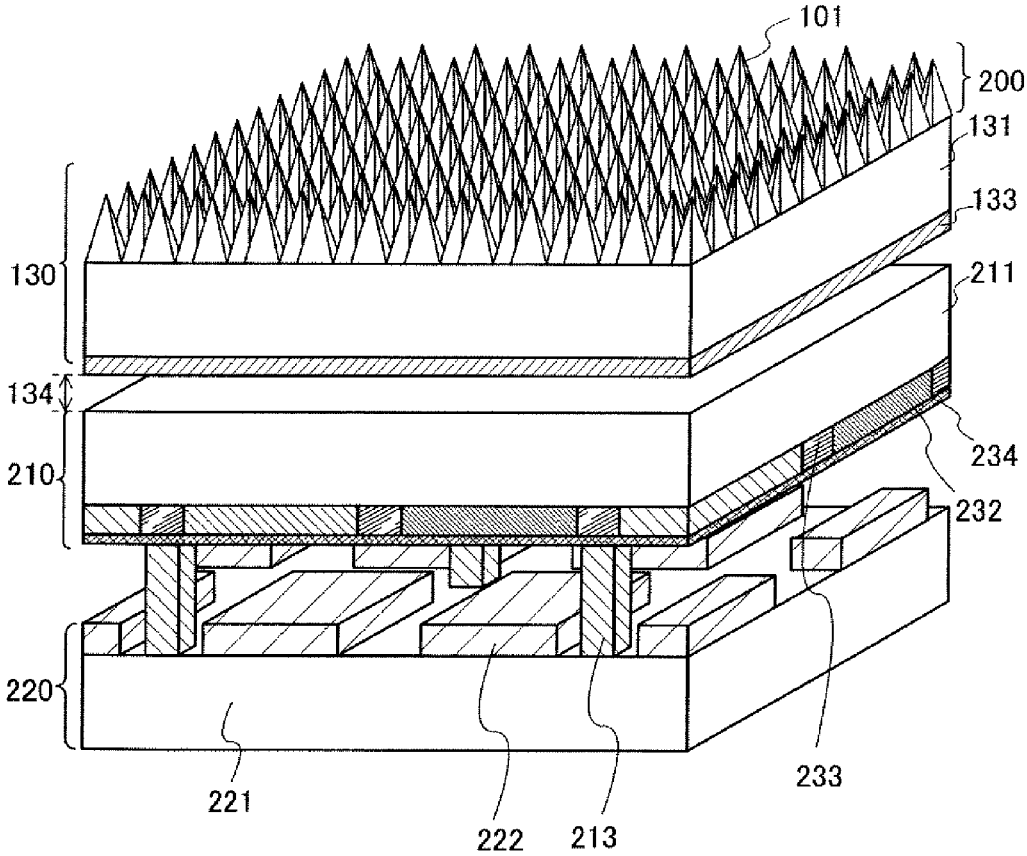
FIG. 16 is a perspective view showing an FED of the present invention.

As shown in FIG. 16, the FED may be formed such that the optical filter 130, in which the electromagnetic wave shielding layer 133 as described in Embodiment Mode 2 is formed on one side of the light-transmitting substrate 131 and the anti-reflection layer 200 as described in Embodiment Mode 1 is formed on the other side of the light-transmitting substrate 131, is formed on a panel in which the periphery of the front substrate 210 and the rear substrate 220 are sealed. Note that in FIG. 16, the mode is shown in which the anti-reflection layer 200 is not formed on the surface of the first light-transmitting substrate 211 of the front substrate 210; however, an anti-reflection layer as described in Embodiment Mode 1 may also be provided on the surface of the first light-transmitting substrate 211 of the front substrate 210. Using such a structure enables reflectance of incident light from an external source to be further reduced.

Figure 17:
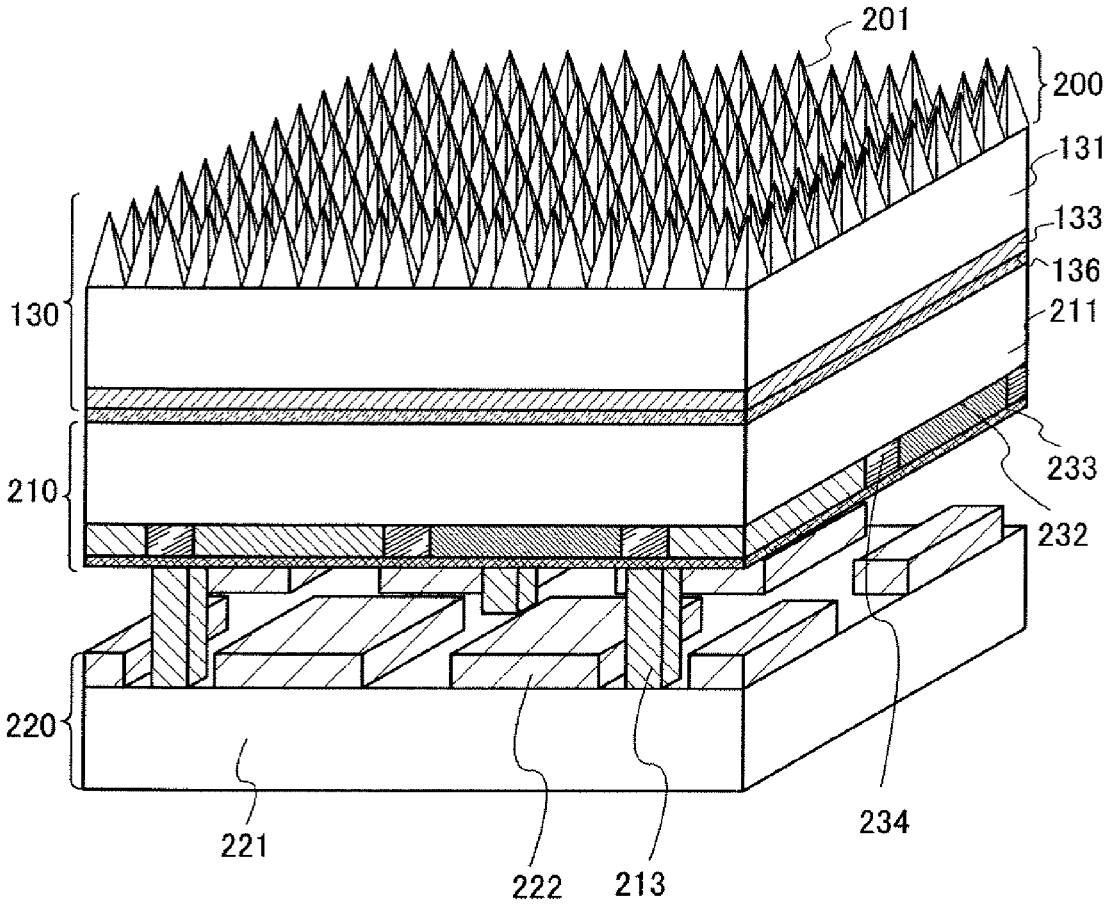
FIG. 17 is a perspective view showing an FED of the present invention.

Note that in FIG. 16, the front substrate 210 and the optical filter 130 are provided with the gap 134 interposed therebetween; however, as shown in FIG. 17, the optical filter 130 and the front substrate 210 may be attached together by using the adhesive 136.

In particular, using plastic for the light-transmitting substrate 131 and providing the optical filter 130 over the surface of the front substrate 210 with the adhesive 136 interposed therebetween enable reduction in thickness and weight of an FED.

Note that here, the structure in which the optical filter 130 is provided with the electromagnetic wave shielding layer 133 and the anti-reflection layer 200 is described; however, a near-infrared ray shielding layer with the electromagnetic wave shielding layer 133 may be provided in a similar manner to Embodiment Mode 2. Furthermore, the electromagnetic wave shielding layer 133 and the near-infrared ray shielding layer 132 may be formed of one functional layer having an electromagnetic wave shield function and a near-infrared light shielding function.

Figure 19:
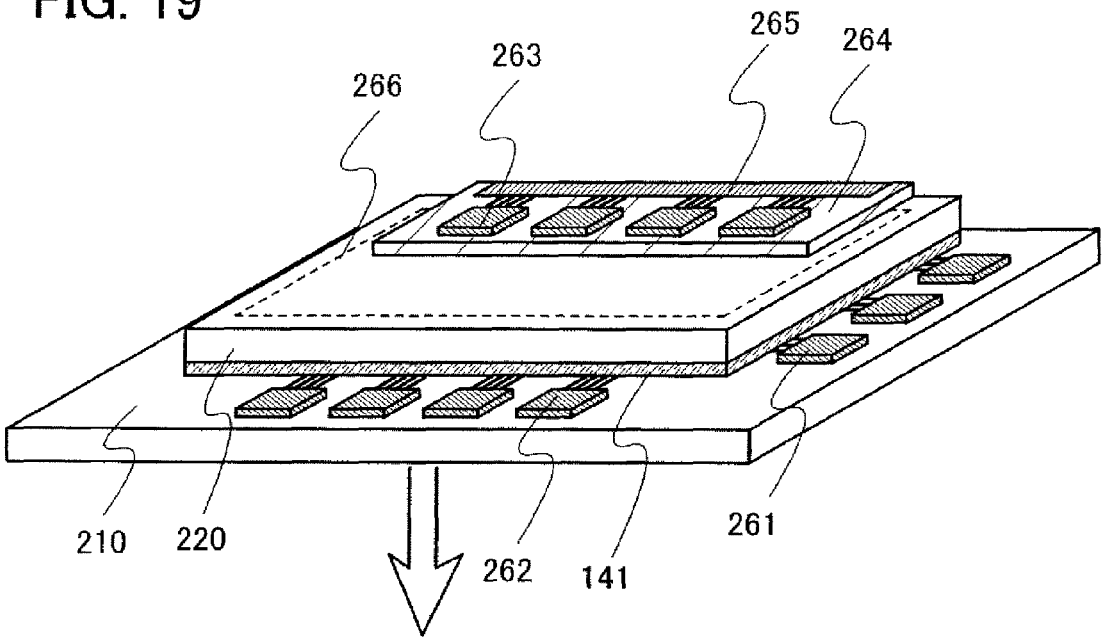
FIG. 19 is a perspective view showing an FED module of the present invention.
Figure 20:
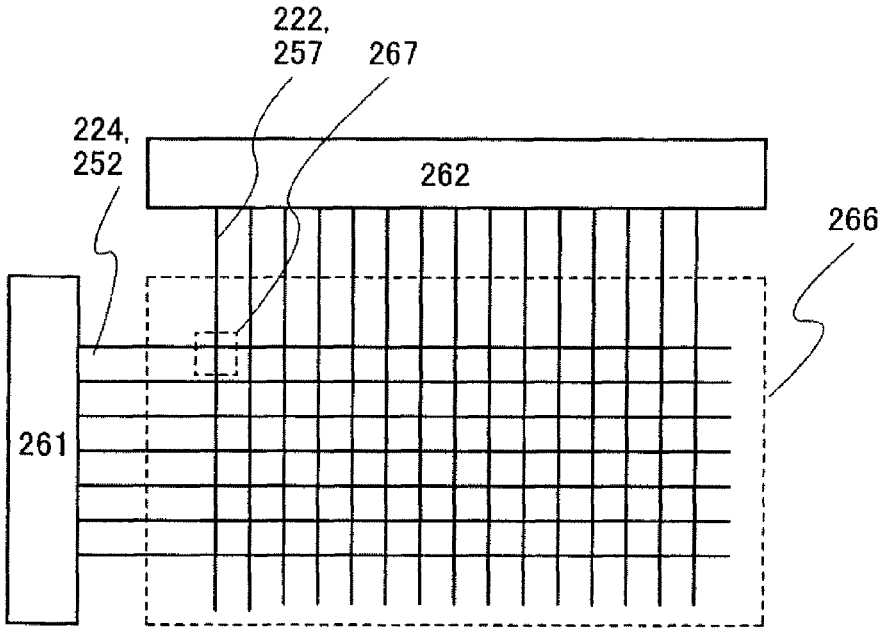
FIG. 20 is a view showing an FED of the present invention.

Next, an FED module having a Spindt-type electron emissive element and a driving method thereof are described with reference to FIGS. 18A, 19, and 20. FIG. 19 is a perspective view of an FED module. FIG. 20 is a schematic diagram of an FED module.

As shown in FIG. 19, the periphery of the front substrate 210 and the rear substrate 220 is sealed with the glass 141 for sealing. A driver circuit 261 which drives the gate electrode and a driver circuit 262 which drives the cathode electrode are provided over the first light-transmitting substrate which is part of the front substrate 210 and are connected to each electrode.

Over the second light-transmitting substrate which is part of the rear substrate 220, a driver circuit 263 which applies a voltage to the metal back (or the anode electrode) is provided and connected to the metal back (or the anode electrode). Here, the driver circuit 263 which applies a voltage to the metal back (or the anode electrode) is provided over a wiring board 264, and the driver circuit 263 and the metal back (or the anode electrode) are connected through an FPC 265. Further, although not shown, a control circuit which controls the driver circuits 261 to 263 is provided over either the first light-transmitting substrate 211 or the second light-transmitting substrate 221.

As shown in FIGS. 18A and 20, a light-emitting cell 267 of a display portion 266 is selected by the driver circuit 261 which drives the gate electrode based on inputted image data from a control portion and the driver circuit 262 which drives the cathode electrode; a voltage is applied to the gate electrode 224 and the cathode electrode 222 in the light-emitting cell 267; and an electron beam is emitted from the electron emissive element 230 of the light-emitting cell 267. In addition, an anode voltage is applied to the metal back 234 (or the anode electrode) by the driver circuit 263 which applies a voltage to the metal back 234 (or the anode electrode). The electron beam 235 emitted from the electron emissive element 230 of the light-emitting cell 267 is accelerated by an anode voltage; a surface of the phosphor layer 232 of the front substrate 210 is irradiated with the electron beam 235 and excited to make the phosphor emit light on the outer side of the front substrate. Moreover, a given cell is selected by the above method, whereby an image can be displayed.

Next, an FED module having a surface-conduction electron emissive element and a driving method thereof are described with reference to FIGS. 18B, 19, and 20.

As shown in FIG. 19, the periphery of the front substrate 210 and the rear substrate 220 is sealed with the glass 141 for sealing. The driver circuit 261 which drives the row electrode and the driver circuit 262 which drives the column electrode are provided over the first light-transmitting substrate which is part of the front substrate 210 and are connected to each electrode.

Over the second light-transmitting substrate which is part of the rear substrate 220, the driver circuit 263 which applies a voltage to a metal back (or an anode electrode) is provided and connected to the metal back (or the anode electrode). Although not shown, a control circuit which controls the driver circuits 261 to 263 is provided over the first light-transmitting substrate 211 or the second light-transmitting substrate 221.

As shown in FIGS. 18B and 20, the light-emitting cell 267 of the display portion 266 is selected by using the driver circuit 261 which drives a row electrode based on inputted image data from a control portion and the driver circuit 262 which drives a column electrode; a voltage is applied between the element electrodes 255 and 256 by applying a voltage to the row direction wiring 252 and the column direction wiring 257 in the light-emitting cell 267; and the electron beam 260 is emitted from the electron emissive element 250 of the light-emitting cell 267. In addition, an anode voltage is applied to the metal back (or the anode electrode) by the driver circuit 263 which applies a voltage to the metal back 234 (or the anode electrode). The electron beam emitted from the electron emissive element 250 is accelerated by an anode voltage; the surface of the phosphor layer 232 of the front substrate 210 is irradiated with the electron beam and excited to make the phosphor emit light on the outer side of the front substrate. Moreover, a given cell is selected by the above method, whereby an image can be displayed.

The FED described in this embodiment mode includes the anti-reflection layer on its surface. The anti-reflection layer includes a plurality of hexagonal pyramid-shaped projections. Incident light from external source reflects on not a viewer side but another adjacent hexagonal pyramid-shaped projection because the interface of each hexagonal pyramid-shaped projection is not perpendicular to a direction of reflection of incident light from an external source. Alternatively, incident light from an external source travels between the adjacent hexagonal pyramid-shaped projections. Part of incident light from an external source transmits an adjacent hexagonal pyramid-shaped projection and the other part of the incident light from an external source is again incident on an adjacent hexagonal pyramid-shaped projection as reflected light. In this manner, incident light from an external source which is reflected at an interface of an adjacent hexagonal pyramid-shaped projection is repeatedly incident on other adjacent hexagonal pyramid-shaped projections.

In other words, concerning the incident light from an external source which is incident on the anti-reflection layer, the number of entering time of incident light from an external source enters the hexagonal pyramid-shaped projection of the FED is increased; therefore, the amount of incident light from external source which transmits the hexagonal pyramid-shaped projection is increased. Thus, the amount of incident light from external source reflected to a viewer side is reduced; thereby a cause of reduction in visibility such as reflection is prevented.

The hexagonal pyramid-shaped projection can be formed of a material, a refractive index of which changes from an apical portion to the side which the substrate serving as the display screen is on instead of a material with a uniform refractive index. For example, a structure can be used in which the apical portion of each of the plurality of hexagonal pyramid-shaped projections is formed of a material having a refractive index equivalent to that of the air, so that reflection of incident light from an external source, which enters the hexagonal pyramid-shaped projection through the air, at a surface of the hexagonal pyramid-shaped projection is further reduced. Meanwhile, when a portion closer to the substrate serving as the display screen is formed of a material having a refractive index equivalent to that of the substrate in each of the plurality of hexagonal projections, reflection of light which travels through the hexagonal pyramid-shaped projection and is incident on the substrate, which occurs at an interface between the hexagonal pyramid-shaped projection and the substrate, can be further reduced. When a glass substrate is used for the substrate, the refractive index of air is smaller than that of a glass substrate. Thus, the apical portion of the hexagonal pyramid-shaped projection may have a structure such that an apical portion of the hexagonal pyramid-shaped projection is formed of a material having a lower refractive index, and a portion closer to a base of each projection is formed of a material having a higher refractive index; that is, the refractive index increases from the apical portion to the base of the hexagonal pyramid-shaped projection.

The FED described in this embodiment mode includes a better anti-reflection function which can further reduce reflection of incident light from an external source by providing the anti-reflection layer having a plurality of adjacent hexagonal pyramid-shaped projections to the surface of the FED. As a result, a FED superior in visibility can be provided, and thus an FED with high definition and high performance can be manufactured.

Embodiment Mode 4

Figure 22:
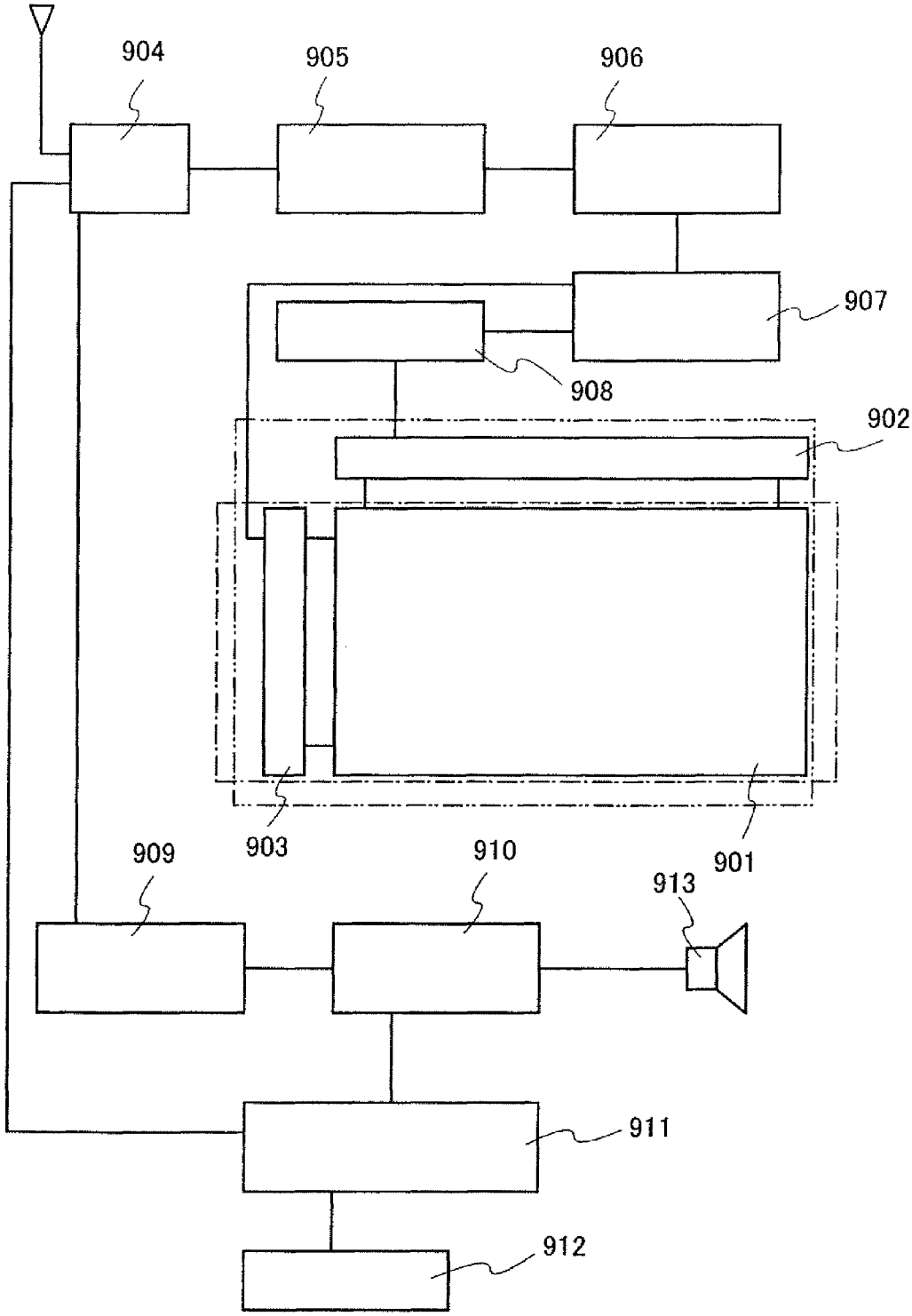
FIG. 22 is a block diagram showing a primary component of an electronic device to which the present invention is applicable.

With the PDP or the FED of the present invention, a television device (also referred to as simply a television, or a television receiver) can be completed. FIG. 22 is a block diagram showing main components of a television device.

Figure 21A:
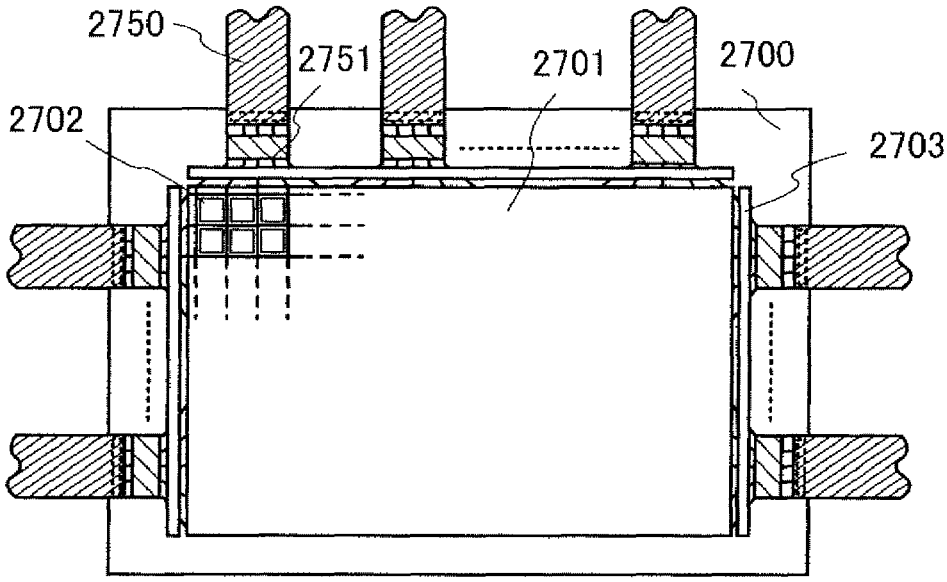
FIGS. 21A and 21B are top views of a PDP and an FED of the present invention.

FIG. 21A is a top view showing a structure of a PDP panel or an FED panel (hereinafter referred to as a display panel). A pixel portion 2701 in which pixels 2702 are arranged in matrix and an input terminal 2703 are formed over a substrate 2700 having an insulating surface. The number of pixels may be determined in accordance with various standards. In the case of XGA full-color display using RGB, the number of pixels may be 1024×768×3 (ROB). In the case of UXGA full-color display using RGB, the number of pixels may be 1600×1200×3 (RGB), and in the case of full-spec, high-definition and full-color display using RGB, the number may be 1920×1080×3 (RGB).

Figure 21B:
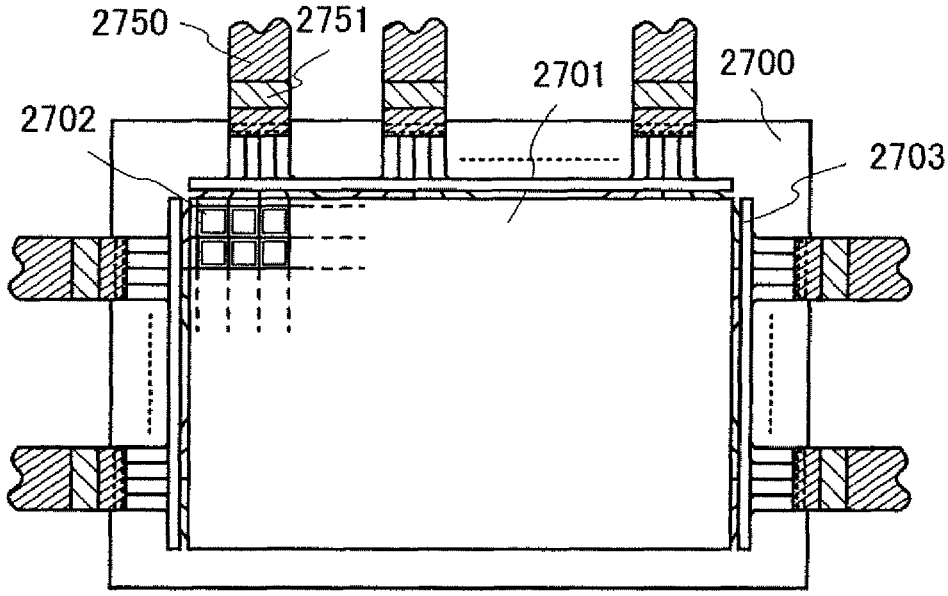

A driver IC 2751 may be mounted on the substrate 2700 by a COG (chip on glass) method, as shown in FIG. 21A. As another mounting mode, a TAB (tape automated bonding) method may be used, as shown in FIG. 21B. The driver IC may be formed using a single crystal semiconductor substrate or may be formed over a glass substrate using a TFT. In FIG. 21A, the driver IC 2751 is connected to an FPC (a flexible printed circuit) 2750.

As another structure of an external circuit in FIG. 22, an input side of video signals is provided the following: a video signal amplifier circuit 905 which amplifies a video signal among signals received by a tuner 904; a video signal processing circuit 906 which converts the signals outputted from the video signal amplifier circuit 905 into chrominance signals corresponding to respective colors of red, green, and blue; a control circuit 907 which converts the video signal into an input specification of the driver IC; and the like. The control circuit 907 outputs signals to both of a scan line side and a signal line side. In the case of digital drive, a signal dividing circuit 908 may be provided on the signal line side and an input digital signal may be divided into m pieces and supplied. Note that 901, 902, and 903 denote a pixel portion, a signal line driver circuit, and a scan line driver circuit, respectively.

Among signals received by the tuner 904, an audio signal is transmitted to an audio signal amplifier circuit 909, and an output thereof is supplied to a speaker 913 through an audio signal processing circuit 910. A control circuit 911 receives control information of a receiving station (reception frequency) or sound volume from an input portion 912 and transmits a signal to the tuner 904 and the audio signal processing circuit 910.

Figure 23A:
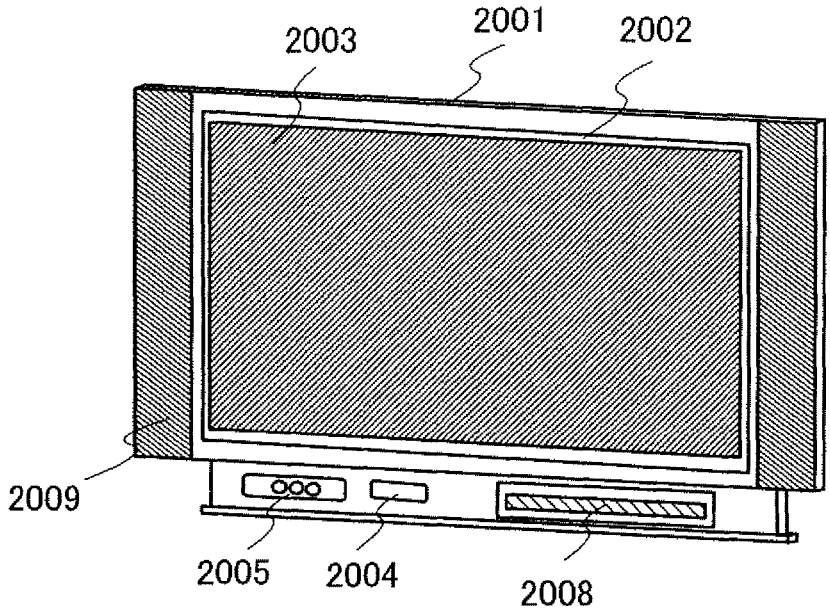
FIGS. 23A and 23B are views showing electronic devices of the present invention.
Figure 23A:
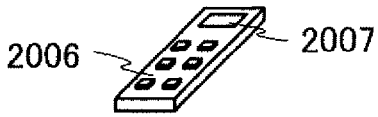
Figure 23B:
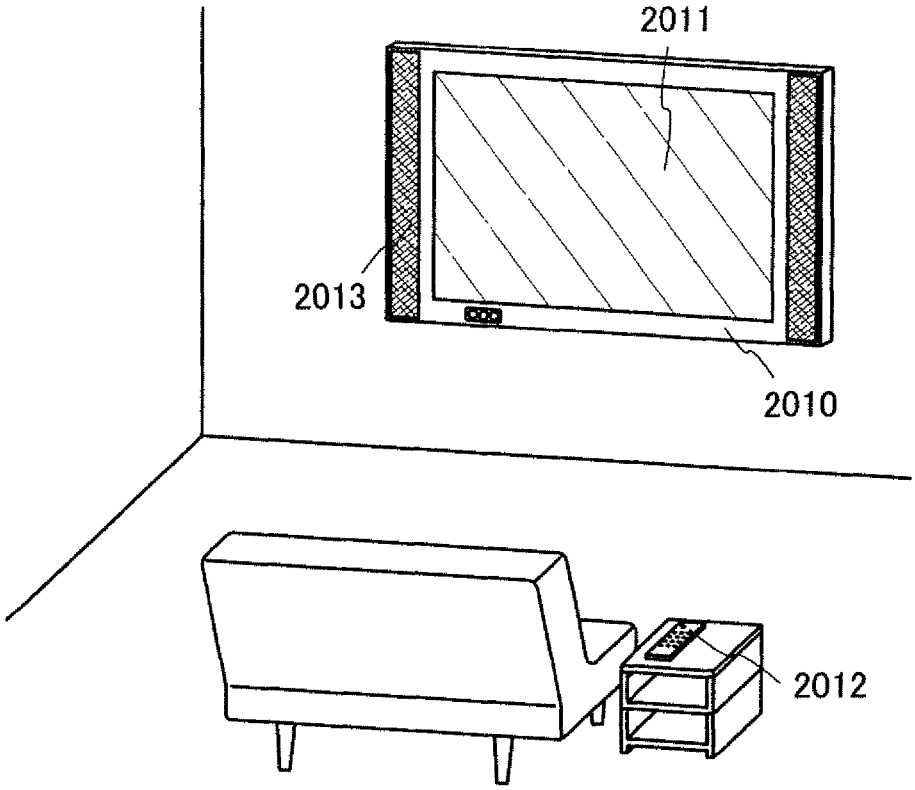

A television device can be completed by incorporating the display module into a chassis as shown in FIGS. 23A and 23B. When a PDP module is used as a display module, a PDP television device can be manufactured. When an FED module is used, an FED television device can be manufactured. In FIG. 23A, a main screen 2003 is formed by using the display module, and a speaker portion 2009, an operation switch, and the like are provided as its accessory equipment. Thus, a television device can be completed in accordance with the present invention.

A display panel 2002 is incorporated in a chassis 2001, and general TV broadcast can be received by a receiver 2005. When the display device is connected to a communication network by wired or wireless connections through a modem 2004, one-way (from a sender to a receiver) or two-way (between a sender and a receiver or between receivers) information communication can be performed. The television device can be operated by a switch built in the chassis 2001 or a remote control unit 2006. A display portion 2007 for displaying output information may also be provided in the remote control device 2006.

Further, the television device may include a sub screen 2008 formed using a second display panel so as to display channels, volume, or the like, as well as the main screen 2003.

FIG. 23B shows a television device having a large-sized display portion, for example, a 20-inch to 80-inch display portion. The television device includes a chassis 2010, a display portion 2011, a remote control device 2012 serving as an operation portion, a speaker portion 2013, and the like. This embodiment mode using the present invention is applied to manufacturing of the display portion 2011. Since the television device in FIG. 23B is a wall-hanging type, it does not require a large installation space.

Naturally, the present invention is not limited to the television device, and can be applied to various use applications, in particular, as a large-sized display medium such as an information display board at a train station, an airport, or the like, or an advertisement display board on the street, as well as a monitor of a personal computer.

This embodiment mode can be combined with any of Embodiment Modes 1 to 3 as appropriate.

Embodiment Mode 5

Examples of electronic devices using a PDP or an FED in accordance with the present invention are as follows: a television device (also referred to as simply a television, or a television receiver), a camera such as a digital camera or a digital video camera, a cellular telephone device (also referred to as simply a mobile phone unit or a mobile phone), a portable information terminal such as a PDA, a portable game machine, a computer monitor, a computer, a sound reproducing device such as a car audio system, an image reproducing device including a recording medium such as a home-use game machine, and the like. In addition, the present invention can be applied to any gaming machine having a display device such as a pachinko machine, a slot machine, a pinball machine, or a large-sized game machine. Specific examples of them are described with reference to FIGS. 24A to 24F.

Figure 24A:
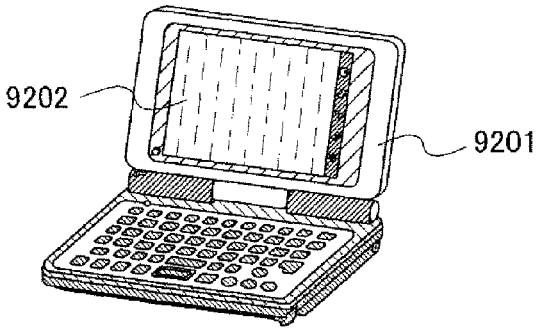
FIGS. 24A to 24F are views showing electronic devices of the present invention.

A portable information terminal device shown in FIG. 24A includes a main body 9201, a display portion 9202, and the like. The FED device of the present invention can be applied to the display portion 9202. As a result, a high-performance portable information terminal device which can display a high-quality image superior in visibility can be provided.

Figure 24B:
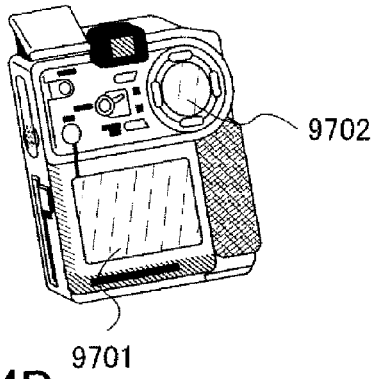

A digital video camera shown in FIG. 24B includes a display portion 9701, a display portion 9702, and the like. The FED of the present invention can be applied to the display portion 9701. As a result, a high-performance digital video camera which can display a high-quality image superior in visibility can be provided.

Figure 24C:
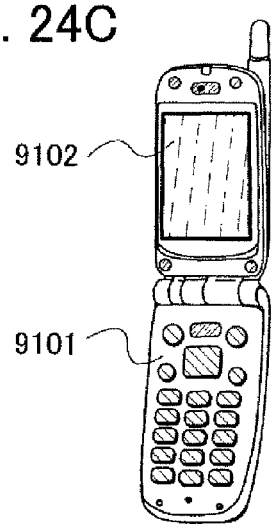

A cellular phone shown in FIG. 24C includes a main body 9101, a display portion 9102, and the like. The FED of the present invention can be applied to the display portion 9102. As a result, a high-performance cellular phone which can display a high-quality image superior in visibility can be provided.

Figure 24D:
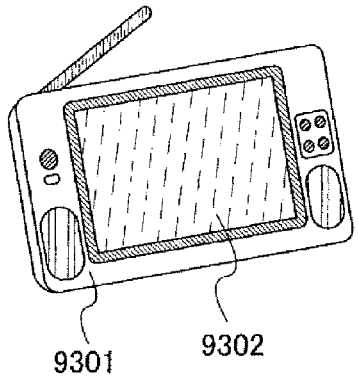

A portable television device shown in FIG. 24D includes a main body 9301, a display portion 9302, and the like. The FED of the present invention can be applied to the display portion 9302. As a result, a high-performance portable television device which can display a high-quality image superior in visibility can be provided. The PDP and the FED of the present invention can be applied to a wide range of television devices, from small-sized television devices mounted on a portable terminal such as a mobile phone, to portable a medium-sized television device, and large-sized (for example, 40-inch or larger) television devices.

Figure 24E:
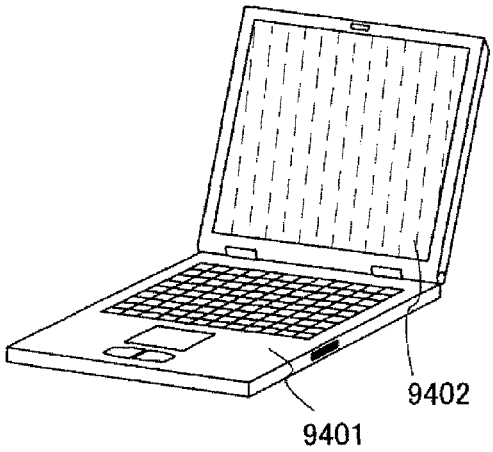

A portable computer shown in FIG. 24E includes a main body 9401, a display portion 9402, and the like. The FED of the present invention can be applied to the display portion 9402. As a result, a high-performance portable computer which can display a high-quality image superior in visibility can be provided.

Figure 24F:
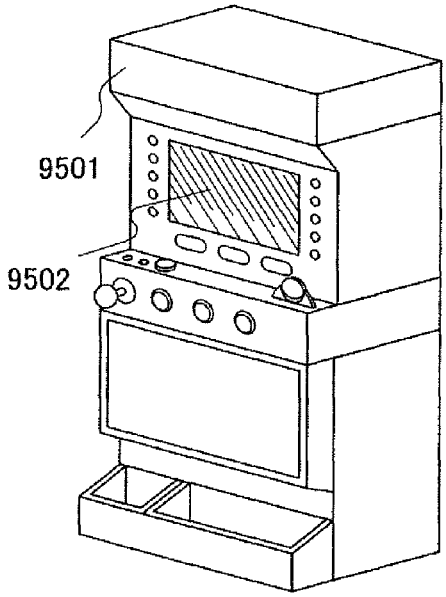

A slot machine shown in FIG. 24F includes a main body 9501, a display portion 9502, and the like. The PDP and the FED of the present invention can be applied to the display portion 9502. As a result, a high-performance slot machine which can display a high-quality image superior in visibility can be provided.

As described above, using the PDP and the FED of the present invention makes it possible to provide a high-performance electronic device which can display a high-quality image superior in visibility.

This embodiment mode can be combined with any of Embodiment Modes 1 to 4 as appropriate.

This application is based on Japanese Patent Application serial no. 2006-327936 filed with Japan Patent Office on Dec. 5, in 2006, the entire contents of which are hereby incorporated by reference.

The invention claimed is:

1. A field emission display comprising:

a pair of substrates;

an electro emission elements provided for one of the pair of substrates;

an electrode provided for the other of the pair of substrates;

a phosphor layer in contact with the electrode; and an anti-reflection layer provided on an outer side of the other substrate, wherein the other substrate has light-transmitting property, wherein the anti-reflection layer has a plurality of hexagonal pyramid-shaped projections, wherein a first corner of a hexagonal base of one of the plurality of hexagonal pyramid-shaped projections is in contact with a first corner of a hexagonal base of an adjacent hexagonal pyramid-shaped projection, wherein a second corner of the hexagonal base of the one of the plurality of hexagonal pyramid-shaped projections is in contact with a second corner of the hexagonal base of the adjacent hexagonal pyramid-shaped projection, wherein the one of the plurality of hexagonal pyramid-shaped projections has a first portion having a first refractive index and a second portion having a second refractive index different from the first refractive index, wherein the first portion is closer to the other substrate than the second portion, and wherein the first refractive index has a closer refractive index to a refractive index of the other substrate than the second refractive index.

2. The field emission display according to claim 1, wherein the second refractive index is smaller than the first refractive index.

3. A field emission display comprising:

a pair of substrates;

an electron emissive element provided for one of the pair of substrates;

an electrode provided for the other of the pair of substrates;

a phosphor layer in contact with the electrode; and an anti-reflection layer provided on an outer side of the other substrate, wherein the other substrate has light-transmitting property, wherein the anti-reflection layer has a plurality of hexagonal pyramid-shaped projections, wherein a side of a hexagonal base of the plurality of hexagonal pyramid-shaped projections is arranged so as to be in contact with a side of a hexagonal base of an adjacent hexagonal pyramid-shaped projection, wherein the one of the plurality of hexagonal pyramid-shaped projections has a first portion having a first refractive index and a second portion having a second refractive index different from the first refractive index, wherein the first portion is closer to the other substrate than the second portion, and wherein the first refractive index has a closer refractive index to a refractive index of the other substrate than the second refractive index.

4. The field emission display according to claim 1 or 3, wherein six adjacent hexagonal pyramid-shaped projections are arranged around a periphery of the one of the plurality of the hexagonal pyramid-shaped projection.

5. The field emission display according to claim 1 or 3, wherein apexes of the plurality of hexagonal pyramid-shaped projections are arranged at regular intervals apart from each other.

6. The field emission display according to claim 1 or 3, wherein each of sides of hexagonal bases of the plurality of hexagonal pyramid-shaped projections is equal in length.

7. The field emission display according to claim 1 or 3, further comprising a near-infrared ray shielding layer.

8. The field emission display according to claim 1 or 3, further comprising an electromagnetic wave shielding layer.

9. The field emission display according to claim 1 or 3, wherein the one of the plurality of hexagonal pyramid-shaped projections has rounded top.

10. The field emission display according to claim 1 or 3, wherein each of sides of hexagonal bases of the plurality of hexagonal pyramid-shaped projections is arranged so as to be in contact with a side of a hexagonal base of an adjacent hexagonal pyramid-shaped projection.

11. The field emission display according to claim 1 or 3, wherein intervals between apexes of the plurality of hexagonal pyramid-shaped projections are equal or less than 350 nm, and the height of each of the plurality of hexagonal pyramid-shaped projections is equal to or greater than 800 nm.

12. The field emission display according to claim 1 or 3, wherein a filling rate per unit area of bases of the plurality of hexagonal pyramid-shaped projections on a surface of a display screen is equal to or greater than 80 percent.

13. The field emission display according to claim 1 or 3, wherein the anti-reflection layer is a part of the other substrate.

14. The field emission display according to claim 1 or 3, wherein the anti-reflection layer is formed of different layer from the other substrate.

15. The field emission display according to claim 3, wherein the second refractive index is smaller than the first refractive index.

16. A plasma display panel comprising:

a pair of substrates;

at least a pair of electrodes interposed between the pair of substrates;

a phosphor layer interposed between the pair of electrodes; and an anti-reflection layer provided on an outer side of one of the pair of substrates, wherein the one of the pair of substrates has a light transmitting property, wherein the anti-reflection layer has a plurality of hexagonal pyramid-shaped projections, wherein a first corner of a hexagonal base of one of the plurality of hexagonal pyramid-shaped projections is in contact with a first corner of a hexagonal base of an adjacent hexagonal pyramid-shaped projection, wherein a second corner of the hexagonal base of the one of the plurality of hexagonal pyramid-shaped projections is in contact with a second corner of the hexagonal base of the adjacent hexagonal pyramid-shaped projection, wherein the one of the plurality of hexagonal pyramid-shaped projections has a first portion having a first refractive index and a second portion having a second refractive index different from the first refractive index, wherein the first portion is closer to the other of the pair of substrates than the second portion, and wherein the first refractive index has a closer refractive index to a refractive index of the other substrate than the second refractive index.

17. The plasma display panel according to claim 16, wherein the anti-reflection layer is a part of the other substrate.

18. The plasma display panel according to claim 16, wherein the anti-reflection layer is formed of different layer from the other substrate.

19. The plasma display panel according to claim 16, wherein the second refractive index is smaller than the first refractive index.

20. A plasma display panel comprising:

a pair of substrates;

at least a pair of electrodes interposed between the pair of substrates;

a phosphor layer interposed between the pair of electrodes; and an anti-reflection layer provided on an outer side of one of the pair of substrates, wherein one of the pair of substrates has a light transmitting property, wherein the anti-reflection layer has a plurality of hexagonal pyramid-shaped projections, wherein a side of a hexagonal base of one of the plurality of hexagonal pyramid-shaped projections is arranged so as to be in contact with a side of a hexagonal base of an adjacent hexagonal pyramid-shaped projection, wherein the one of the plurality of hexagonal pyramid-shaped projections has a first portion having a first refractive index and a second portion having a second refractive index different from the first refractive index, wherein the first portion is closer to the other of the pair of substrates than the second portion, and wherein the first refractive index has a closer refractive index to a refractive index of the other substrate than the second refractive index.

21. The plasma display panel according to claim 16 or 20, wherein six adjacent hexagonal pyramid-shaped projections are arranged around a periphery of the one of the plurality of hexagonal pyramid-shaped projections.

22. The plasma display panel according to claim 16 or 20, wherein apexes of the plurality of hexagonal pyramid-shaped projections are arranged at regular intervals apart from each other.

23. The plasma display panel according to claim 16 or 20, wherein each of sides of hexagonal bases of the plurality of hexagonal pyramid-shaped projections is equal in length.

24. The plasma display panel according to claim 16 or 20, further comprising a near-infrared ray shielding layer.

25. The plasma display panel according to claim 16 or 20, further comprising an electromagnetic wave shielding layer.

26. The plasma display panel according to claim 16 or 20, wherein the one of the plurality of hexagonal pyramid-shaped projections has rounded top.

27. The plasma display panel according to claim 16 or 20, wherein each of sides of hexagonal bases of the plurality of hexagonal pyramid-shaped projections is arranged so as to be in contact with a side of a hexagonal base of an adjacent hexagonal pyramid-shaped projection.

28. The plasma display panel according to claim 16 or 20, wherein intervals between apexes of the plurality of hexagonal pyramid-shaped projections are equal to or less than 350 nm, and the height of the plurality of hexagonal pyramid-shaped projections is equal to or greater than 800 nm.

29. The plasma display panel according to claim 16 or 20, wherein a filling rate per unit area of bases of the plurality of hexagonal pyramid-shaped projections on a surface of a display screen is equal to or greater than 80 percent.

30. The plasma display panel according to claim 20, wherein the anti-reflection layer is a part of the other substrate.

31. The plasma display panel according to claim 20, wherein the anti-reflection layer is formed of different layer from the other substrate.

32. The plasma display panel according to claim 20, wherein the second refractive index is smaller than the first refractive index.

* * * * *

UNITED STATES PATENT AND TRADEMARK OFFICE

CERTIFICATE OF CORRECTION

PATENT NO. : 7,839,061 B2
APPLICATION NO. : 11/950628
DATED : November 23, 2010
INVENTOR(S) : Yuji Egi et al.

It is certified that error appears in the above-identified patent and that said Letters Patent is hereby corrected as shown below:

Column 11, line 54, "412*h*" should read "412*b*"

Column 12, line 53, "anti-refection" should read "anti-reflection"

Column 13, line 37, "112*c*" should read "112*b*"

Column 15, line 28, "FIG. 1A," should read "FIG. 10A,"

Column 15, line 34, "140" should read "110"

Column 17, line 40, "FIG. 4" should read "FIG. 14"

Signed and Sealed this
Twenty-second Day of November, 2011

David J. Kappos

David J. Kappos
*Director of the United States Patent and Trademark Office*